US009434538B2

(12) United States Patent
Yang et al.

(10) Patent No.: US 9,434,538 B2
(45) Date of Patent: Sep. 6, 2016

(54) TRASH CAN

(75) Inventors: Frank Yang, Rancho Palos Verdes, CA (US); Tzu-Hao Wei, Hacienda Heights, CA (US); Joseph Sandor, Santa Ana Heights, CA (US)

(73) Assignee: simplehuman, LLC, Torrance, CA (US)

( * ) Notice: Subject to any disclaimer, the term of this patent is extended or adjusted under 35 U.S.C. 154(b) by 1075 days.

(21) Appl. No.: 13/047,662

(22) Filed: Mar. 14, 2011

(65) Prior Publication Data

US 2011/0220655 A1 Sep. 15, 2011

Related U.S. Application Data

(60) Provisional application No. 61/313,679, filed on Mar. 12, 2010.

(51) Int. Cl.

| | |
|---|---|
| ***B65D 43/26*** | (2006.01) |
| ***B65F 1/14*** | (2006.01) |
| ***B65F 1/00*** | (2006.01) |
| *B65F 1/06* | (2006.01) |
| *B65F 1/16* | (2006.01) |

(52) U.S. Cl.

CPC ..... *B65F 1/1468* (2013.01); *B65F 1/004* (2013.01); *B65F 1/163* (2013.01); *B65F 1/1615* (2013.01); *B65F 1/06* (2013.01); *B65F 2001/1661* (2013.01); *B65F 2220/12* (2013.01)

(58) Field of Classification Search

USPC ..... 220/675, 323, 262, 810, 263, 324, 908, 220/326, 260, 315, 264, 827, 532, 529, 533

See application file for complete search history.

(56) References Cited

U.S. PATENT DOCUMENTS

| | | | |
|---|---|---|---|
| 830,182 | A | 9/1906 | Skov |
| 1,426,211 | A | 8/1922 | Pausin |
| 1,461,253 | A | 7/1923 | Obadiah |
| 1,754,802 | A | 4/1930 | Raster |
| 1,820,555 | A | 8/1931 | Buschman |
| 1,891,651 | A | 12/1932 | Padelford et al. |
| 1,922,729 | A | 8/1933 | Giebel |
| 1,980,938 | A | 11/1934 | Geibel |
| 2,308,326 | A | 1/1943 | Calcagno |
| D148,825 | S | 2/1948 | Snider |
| 2,457,274 | A | 12/1948 | Rifken |
| 2,759,625 | A | 8/1956 | Ritter |

(Continued)

FOREIGN PATENT DOCUMENTS

| | | |
|---|---|---|
| AU | 622536 | 4/1992 |
| AU | 365296 | 11/2015 |

(Continued)

OTHER PUBLICATIONS

U.S. Appl. No. 13/417,084, filed Mar. 9, 2012.

(Continued)

*Primary Examiner* — Jeffrey Allen

(74) *Attorney, Agent, or Firm* — Knobbe, Martens, Olson & Bear, LLP

(57) ABSTRACT

A trashcan with a lid can include a pedal bar and a pedal protector. The pedal protector can be flipped and/or rotated, such that the pedal protector can be moved adjacent the pedal (e.g. below the pedal) or away from the pedal bar. The trashcan with a lid can further include at least one notch and/or divider to allow for insertion of more than one trash bag into the body of the trashcan.

35 Claims, 32 Drawing Sheets

(56) References Cited

U.S. PATENT DOCUMENTS 2,888,307 A 5/1959 Graves et al.
2,946,474 A 7/1960 Knapp
3,008,604 A 11/1961 Garner
3,023,922 A 3/1962 Arrington et al.
3,137,408 A 6/1964 Taylor
3,654,534 A 4/1972 Fischer
3,800,503 A 4/1974 Maki
3,820,200 A 6/1974 Myers
3,825,150 A 7/1974 Taylor
3,825,215 A 7/1974 Borglum
3,886,425 A 5/1975 Weiss
3,888,406 A 6/1975 Nippes
3,891,115 A 6/1975 Ono
4,014,457 A 3/1977 Hodge
4,027,774 A 6/1977 Cote
4,081,105 A 3/1978 Dagonnet et al.
4,189,808 A 2/1980 Brown
4,200,197 A 4/1980 Meyer et al.
4,217,616 A 8/1980 Jessup
4,303,174 A 12/1981 Anderson
4,320,851 A 3/1982 Montoya
4,349,123 A 9/1982 Yang
4,357,740 A 11/1982 Brown
4,416,197 A 11/1983 Kehl
4,417,669 A 11/1983 Knowles et al.
4,457,483 A 7/1984 Gagne
4,535,911 A 8/1985 Goulter
4,570,304 A 2/1986 Montreuil et al.
4,576,310 A 3/1986 Isgar et al.
D284,320 S 6/1986 Kubic et al.
4,609,117 A 9/1986 Pamment
4,630,332 A 12/1986 Bisbing
4,630,752 A 12/1986 DeMars
4,664,347 A 5/1987 Brown et al.
4,697,312 A 10/1987 Freyer
4,711,161 A 12/1987 Swin et al.
4,729,490 A 3/1988 Ziegenbein
4,753,367 A 6/1988 Miller et al.
4,763,808 A 8/1988 Guhl et al.
4,765,548 A 8/1988 Sing
4,765,579 A 8/1988 Robbins et al.
4,785,964 A 11/1988 Miller et al.
4,792,039 A 12/1988 Dayton
4,794,973 A 1/1989 Perisic
4,823,979 A 4/1989 Clark, Jr.
4,834,260 A 5/1989 Auten
4,863,053 A 9/1989 Oberg
4,867,339 A 9/1989 Hahn
4,869,391 A 9/1989 Farrington
4,884,717 A 12/1989 Bussard et al.
4,892,223 A 1/1990 DeMent
4,892,224 A 1/1990 Graham
4,913,308 A 4/1990 Culbertson
4,915,347 A 4/1990 Iqbal et al.
4,918,568 A 4/1990 Stone et al.
D308,272 S 5/1990 Koepsell
4,923,087 A 5/1990 Burrows
4,944,419 A 7/1990 Chandler
4,948,004 A 8/1990 Chich
4,964,523 A 10/1990 Bieltvedt et al.
4,972,966 A 11/1990 Craft, Jr.
4,996,467 A 2/1991 Day
5,031,793 A 7/1991 Chen et al.
5,048,903 A 9/1991 Loblein
5,054,724 A 10/1991 Hutcheson
5,065,272 A 11/1991 Owen et al.
5,065,891 A 11/1991 Casey
5,076,462 A * 12/1991 Perrone ..... 220/495.11
D323,573 S 1/1992 Schneider
5,090,585 A 2/1992 Power
5,090,785 A 2/1992 Stamp
5,100,087 A 3/1992 Ashby
5,111,958 A 5/1992 Witthoeft
D327,760 S 7/1992 Donnelly
D329,929 S 9/1992 Knoedler et al.
5,147,055 A 9/1992 Samson et al.
5,156,290 A 10/1992 Rodrigues
5,170,904 A 12/1992 Neuhaus
5,174,462 A 12/1992 Hames
D335,562 S 5/1993 Evans
5,213,272 A 5/1993 Gallagher et al.
5,222,704 A 6/1993 Light
D337,181 S 7/1993 Warman
5,226,558 A 7/1993 Whitney et al.
5,230,525 A 7/1993 Delmerico et al.
5,242,074 A 9/1993 Conaway et al.
D340,333 S 10/1993 Duran et al.
5,249,693 A 10/1993 Gillispie et al.
5,261,553 A 11/1993 Mueller et al.
5,265,511 A 11/1993 Itzov
5,295,607 A 3/1994 Chang
5,305,916 A 4/1994 Suzuki et al.
5,314,151 A 5/1994 Carter-Mann
5,322,179 A 6/1994 Ting
5,329,212 A 7/1994 Feigleson
5,348,222 A 9/1994 Patey
5,353,950 A 10/1994 Taylor et al.
5,372,272 A 12/1994 Jennings
5,381,588 A 1/1995 Nelson
5,385,258 A 1/1995 Sutherlin
5,390,818 A 2/1995 LaBuda
5,404,621 A 4/1995 Heinke
5,407,089 A 4/1995 Bird et al.
5,419,452 A 5/1995 Mueller et al.
5,471,708 A 12/1995 Lynch
5,474,201 A 12/1995 Liu
5,501,358 A 3/1996 Hobday
5,520,067 A 5/1996 Gabas
5,520,303 A 5/1996 Bernstein et al.
5,531,348 A 7/1996 Baker et al.
5,535,913 A 7/1996 Asbach et al.
5,558,254 A 9/1996 Anderson et al.
5,584,412 A * 12/1996 Wang ..... 220/500
D377,554 S 1/1997 Adriaansen
5,611,507 A 3/1997 Smith
5,628,424 A 5/1997 Gola
5,632,401 A 5/1997 Hurd
5,636,416 A 6/1997 Anderson
5,636,761 A 6/1997 Diamond et al.
5,644,111 A 7/1997 Cerny et al.
5,645,186 A 7/1997 Powers et al.
5,650,680 A 7/1997 Chula
D383,277 S 9/1997 Peters
5,662,235 A 9/1997 Nieto
5,671,847 A 9/1997 Pedersen et al.
5,690,247 A 11/1997 Boover
5,695,088 A 12/1997 Kasbohm
5,699,929 A 12/1997 Ouno
D388,922 S 1/1998 Peters
D389,631 S 1/1998 Peters
5,704,511 A 1/1998 Kellams
5,724,837 A 3/1998 Shin
5,730,312 A 3/1998 Hung
5,732,845 A 3/1998 Armaly, Jr.
5,735,495 A 4/1998 Kubota
5,738,239 A 4/1998 Triglia
5,799,909 A 9/1998 Ziegler
5,816,431 A 10/1998 Giannopoulos
5,816,640 A 10/1998 Nishimura
D401,383 S 11/1998 Gish
D401,719 S 11/1998 Van Leeuwen et al.
5,873,643 A 2/1999 Burgess, Jr. et al.
5,881,896 A 3/1999 Presnell et al.
5,881,901 A 3/1999 Hampton
5,884,237 A 3/1999 Kanki et al.
5,887,748 A 3/1999 Nguyen
5,961,105 A 10/1999 Ehrnsberger et al.
5,967,392 A 10/1999 Niemi et al.
5,987,708 A 11/1999 Newton
6,000,569 A 12/1999 Liu
6,010,024 A 1/2000 Wang
6,024,238 A 2/2000 Jaros
6,036,050 A 3/2000 Ruane
6,102,239 A 8/2000 Wien

(56) References Cited

U.S. PATENT DOCUMENTS

| | | | |
|---|---|---|---|
| 6,105,859 | A | 8/2000 | Stafford |
| 6,123,215 | A | 9/2000 | Windle |
| D431,700 | S | 10/2000 | Roudebush |
| 6,126,031 | A | 10/2000 | Reason |
| 6,129,233 | A | 10/2000 | Schiller |
| 6,131,861 | A | 10/2000 | Fortier, Jr. et al. |
| D435,951 | S | 1/2001 | Yang et al. |
| 6,209,744 | B1 | 4/2001 | Gill |
| 6,211,637 | B1 | 4/2001 | Studer |
| 6,234,339 | B1 | 5/2001 | Thomas |
| 6,250,492 | B1 | 6/2001 | Verbeek |
| D445,980 | S | 7/2001 | Tjugum |
| 6,286,706 | B1 | 9/2001 | Tucker |
| 6,328,320 | B1 | 12/2001 | Walski et al. |
| 6,345,725 | B1 | 2/2002 | Lin |
| 6,364,147 | B1 | 4/2002 | Meinzinger et al. |
| 6,386,386 | B1 | 5/2002 | George |
| 6,390,321 | B1 | 5/2002 | Wang |
| 6,401,958 | B1 | 6/2002 | Foss et al. |
| 6,519,130 | B1 | 2/2003 | Breslow |
| 6,557,716 | B1 | 5/2003 | Chan |
| D476,456 | S | 6/2003 | Englert et al. |
| 6,596,983 | B2 | 7/2003 | Brent |
| 6,626,316 | B2 | 9/2003 | Yang |
| 6,626,317 | B2 | 9/2003 | Pfiefer et al. |
| 6,632,064 | B1 | 10/2003 | Walker et al. |
| D482,169 | S | 11/2003 | Lin |
| 6,659,407 | B2 | 12/2003 | Asaro |
| 6,681,950 | B2 | 1/2004 | Miller, Jr. et al. |
| D488,604 | S | 4/2004 | Yang et al. |
| D488,903 | S | 4/2004 | Yang et al. |
| D489,503 | S | 5/2004 | Lin |
| D489,857 | S | 5/2004 | Yang et al. |
| D490,583 | S | 5/2004 | Yang et al. |
| D490,954 | S | 6/2004 | Brand |
| D491,706 | S | 6/2004 | Yang et al. |
| 6,758,366 | B2 | 7/2004 | Bourgund et al. |
| D493,930 | S | 8/2004 | Wang |
| D494,723 | S | 8/2004 | Lin |
| 6,812,655 | B1 | 11/2004 | Wang et al. |
| 6,814,249 | B2 | 11/2004 | Lin |
| D499,450 | S | 12/2004 | Goodman et al. |
| 6,837,393 | B1 | 1/2005 | Kuo |
| 6,857,538 | B2 | 2/2005 | Lin |
| 6,859,005 | B2 | 2/2005 | Boliver |
| D503,021 | S | 3/2005 | Yang et al. |
| 6,866,826 | B2 | 3/2005 | Moore et al. |
| 6,883,676 | B2 | 4/2005 | Lin |
| D507,090 | S | 7/2005 | Yang et al. |
| 6,920,994 | B2 | 7/2005 | Lin |
| 6,974,948 | B1 | 12/2005 | Brent |
| D513,445 | S | 1/2006 | Lin |
| 6,981,606 | B2 | 1/2006 | Yang et al. |
| D517,764 | S | 3/2006 | Wang |
| D517,767 | S | 3/2006 | Yang et al. |
| D518,266 | S | 3/2006 | Yang et al. |
| 7,017,773 | B2 | 3/2006 | Gruber et al. |
| 7,044,323 | B2 | 5/2006 | Yang |
| D525,756 | S | 7/2006 | Yang et al. |
| 7,073,677 | B2 | 7/2006 | Richardson et al. |
| 7,077,283 | B2 | 7/2006 | Yang et al. |
| 7,080,750 | B2 | 7/2006 | Wein et al. |
| 7,086,550 | B2 | 8/2006 | Yang et al. |
| D528,726 | S | 9/2006 | Lin |
| 7,121,421 | B2 | 10/2006 | Yang et al. |
| D531,499 | S | 11/2006 | Zaidman |
| D535,799 | S | 1/2007 | Epps |
| D535,800 | S | 1/2007 | Yang et al. |
| 7,168,591 | B1 | 1/2007 | Miller |
| D537,223 | S | 2/2007 | Lin |
| D537,599 | S | 2/2007 | Lin |
| D537,601 | S | 2/2007 | Lin |
| D537,999 | S | 3/2007 | Lin |
| D538,995 | S | 3/2007 | Lin |
| D539,498 | S | 3/2007 | Yang et al. |
| D539,499 | S | 3/2007 | Yang et al. |
| D540,001 | S | 4/2007 | Zimmerman |
| D542,001 | S | 5/2007 | Yang et al |
| D542,995 | S | 5/2007 | Lin |
| D543,673 | S | 5/2007 | Yang et al. |
| D544,170 | S | 6/2007 | Lin |
| D544,171 | S | 6/2007 | Lin |
| D544,671 | S | 6/2007 | Saunders et al. |
| D545,024 | S | 6/2007 | Liao |
| 7,225,943 | B2 | 6/2007 | Yang et al. |
| D547,020 | S | 7/2007 | Chen |
| 7,243,811 | B1 | 7/2007 | Ramsey |
| D550,918 | S | 9/2007 | Wang et al. |
| D552,319 | S | 10/2007 | Gusdorf |
| D552,321 | S | 10/2007 | Yang et al. |
| D552,823 | S | 10/2007 | Yang et al. |
| D552,824 | S | 10/2007 | Zimmerman |
| D552,825 | S | 10/2007 | Yang et al. |
| D555,320 | S | 11/2007 | Yang et al. |
| D559,494 | S | 1/2008 | Yang et al. |
| D559,495 | S | 1/2008 | Yang et al. |
| D562,522 | S | 2/2008 | Daams |
| 7,328,842 | B2 | 2/2008 | Wagner et al. |
| D564,169 | S | 3/2008 | Wang |
| D564,723 | S | 3/2008 | Yang et al. |
| D566,367 | S | 4/2008 | Lin |
| D566,369 | S | 4/2008 | Shek |
| D566,923 | S | 4/2008 | Lin |
| D567,468 | S | 4/2008 | Yang et al. |
| D568,572 | S | 5/2008 | Yang et al. |
| 7,374,060 | B2 | 5/2008 | Yang et al. |
| D571,520 | S | 6/2008 | Lin |
| 7,395,990 | B1 | 7/2008 | Stevens |
| 7,398,913 | B2 | 7/2008 | McClure |
| 7,404,499 | B1 | 7/2008 | Ramsey |
| D574,569 | S | 8/2008 | Yang et al. |
| D576,371 | S | 9/2008 | Zimmerman |
| D578,265 | S | 10/2008 | Presnell |
| D578,266 | S | 10/2008 | Yang et al. |
| D578,268 | S | 10/2008 | Yang et al. |
| D578,722 | S | 10/2008 | Yang et al. |
| 7,438,199 | B1 | 10/2008 | Tidrick |
| D580,120 | S | 11/2008 | Lin |
| D580,613 | S | 11/2008 | Yang et al. |
| D580,615 | S | 11/2008 | Yang et al. |
| D581,622 | S | 11/2008 | Presnell et al. |
| D584,470 | S | 1/2009 | Bizzell et al. |
| D585,171 | S | 1/2009 | Bizzell et al. |
| D585,618 | S | 1/2009 | Yang et al. |
| D586,070 | S | 2/2009 | Lin |
| 7,494,021 | B2 | 2/2009 | Yang et al. |
| D587,874 | S | 3/2009 | Lin |
| D593,271 | S | 5/2009 | Yang et al. |
| 7,540,396 | B2 | 6/2009 | Yang et al. |
| 7,543,716 | B2 | 6/2009 | Lin |
| 7,559,433 | B2 | 7/2009 | Yang et al. |
| D599,074 | S | 8/2009 | Bizzell et al. |
| D603,119 | S | 10/2009 | Yang et al. |
| 7,607,552 | B2 | 10/2009 | Efstathiou |
| D604,472 | S | 11/2009 | Blanks et al. |
| 7,614,519 | B2 | 11/2009 | Krauth et al. |
| 7,621,420 | B2 | 11/2009 | Bandoh et al. |
| 7,656,109 | B2 | 2/2010 | Yang et al. |
| D611,216 | S | 3/2010 | Yang et al. |
| D611,217 | S | 3/2010 | Bizzell et al. |
| D611,671 | S | 3/2010 | Yang et al. |
| 7,694,838 | B2 | 4/2010 | Yang et al. |
| 7,703,622 | B1 | 4/2010 | Bynoe |
| D615,270 | S | 5/2010 | Yang et al. |
| D615,722 | S | 5/2010 | Yang et al. |
| 7,712,285 | B2 | 5/2010 | Stravitz et al. |
| 7,741,801 | B2 | 6/2010 | Fukuizumi |
| 7,748,556 | B2 | 7/2010 | Yang et al. |
| 7,781,995 | B2 | 8/2010 | Yang et al. |
| D623,817 | S | 9/2010 | Yang et al. |
| D625,068 | S | 10/2010 | Shannon |
| 7,806,285 | B2 | 10/2010 | Yang et al. |
| D627,533 | S | 11/2010 | Yang et al. |
| D627,944 | S | 11/2010 | Wang et al. |

(56) References Cited

U.S. PATENT DOCUMENTS

D629,172 S 12/2010 Liao
D630,404 S 1/2011 Yang et al.
D631,221 S 1/2011 Yang et al.
D632,864 S 2/2011 Yang et al.
D634,911 S 3/2011 Yang et al.
D635,319 S 3/2011 Meyerhoffer
7,896,187 B2 3/2011 Haibel
7,922,024 B2 4/2011 Yang et al.
7,950,543 B2 5/2011 Yang et al.
D644,390 S 8/2011 Smeets et al.
7,992,742 B1 8/2011 Kim
8,006,857 B2 8/2011 Lin
D644,806 S 9/2011 Yang et al.
D644,807 S 9/2011 Yang et al.
D649,728 S 11/2011 Campbell
8,074,833 B2 12/2011 Yang et al.
8,096,445 B2 1/2012 Yang et al.
8,136,688 B2 3/2012 Lee et al.
D657,108 S 4/2012 Yang et al.
D657,109 S 4/2012 Liao
8,297,470 B2 10/2012 Yang et al.
8,317,055 B2 11/2012 Zawrotny et al.
D672,520 S 12/2012 Yang et al.
D673,750 S 1/2013 Quan
D675,802 S 2/2013 Yang et al.
D675,803 S 2/2013 Yang et al.
8,418,869 B2 4/2013 Yang et al.
D689,255 S 9/2013 Sun Ting Kung et al.
8,567,630 B2 10/2013 Yang et al.
8,569,980 B2 10/2013 Yang et al.
8,575,537 B2 11/2013 Yao et al.
8,672,171 B2 3/2014 Wynn et al.
8,686,676 B2 4/2014 Yang et al.
8,716,969 B2 5/2014 Yang et al.
8,720,728 B2 5/2014 Yang et al.
8,766,582 B2 7/2014 Yang et al.
8,807,378 B2 8/2014 Kaberna
8,807,379 B1 8/2014 Hammond
D714,510 S 9/2014 Yang et al.
D716,015 S 10/2014 van de Leest
8,872,459 B2 10/2014 Yang et al.
D725,861 S 3/2015 Yang et al.
D730,008 S 5/2015 Yang et al.
9,051,093 B2 6/2015 Yang et al.
2001/0002690 A1 6/2001 Rosky
2001/0020619 A1 9/2001 Pfeifer et al.
2002/0079315 A1 6/2002 Yang
2002/0092853 A1 7/2002 Wang
2002/0096523 A1 7/2002 Pyles
2002/0096524 A1 7/2002 Hardesty
2002/0104266 A1 8/2002 Ranaudo
2002/0116924 A1 8/2002 Winkelmann et al.
2003/0089719 A1 5/2003 Berger
2003/0102316 A1 6/2003 Forest
2003/0201265 A1 10/2003 Lin
2003/0201267 A1 10/2003 Yang et al.
2003/0230576 A1 12/2003 Lin
2004/0004080 A1 1/2004 Yang et al.
2004/0016756 A1 1/2004 Lin
2004/0020927 A1 2/2004 Yang et al.
2004/0134924 A1 7/2004 Hansen et al.
2004/0140782 A1 7/2004 Okabe et al.
2004/0164077 A1 8/2004 Kuo
2004/0174268 A1 9/2004 Scott et al.
2004/0175303 A1 9/2004 Lin
2004/0199401 A1 10/2004 Wagner
2004/0200938 A1 10/2004 Forlivio
2004/0206758 A1 10/2004 Lin
2004/0206760 A1 10/2004 Gagnebin
2004/0251746 A1 12/2004 Ichimaru et al.
2005/0017006 A1 1/2005 Kuo
2005/0017010 A1 1/2005 Siegel et al.
2005/0029281 A1 2/2005 Westermann et al.
2005/0103788 A1 5/2005 Yang et al.
2005/0133506 A1 6/2005 Yang et al.
2005/0230396 A1 10/2005 Yang et al.
2005/0230397 A1 10/2005 Yang et al.
2005/0258177 A1 11/2005 Woodson
2005/0258794 A1 11/2005 Fukuizumi
2005/0284870 A1 12/2005 Yang et al.
2006/0027579 A1 2/2006 Yang et al.
2006/0056741 A1 3/2006 Yang et al.
2006/0103086 A1* 5/2006 Niemeyer et al. ..... 280/47.26
2006/0163257 A1 7/2006 Golbert
2006/0175336 A1 8/2006 Wang
2006/0186121 A1 8/2006 Yang et al.
2006/0196874 A1 9/2006 Yang
2006/0213910 A1 9/2006 Yang et al.
2006/0226149 A1 10/2006 Yang et al.
2006/0237641 A1 10/2006 Moeller et al.
2006/0249510 A1 11/2006 Lin
2006/0255033 A1 11/2006 Yang et al.
2006/0261071 A1 11/2006 Yang et al.
2006/0278643 A1 12/2006 Chiou
2007/0012699 A1 1/2007 Yang
2007/0034334 A1 2/2007 Ramsey et al.
2007/0045326 A1 3/2007 Tramontina et al.
2007/0090112 A1 4/2007 Kalman et al.
2007/0114847 A1 5/2007 Ichimaru et al.
2007/0181579 A1 8/2007 Kuo et al.
2007/0182551 A1 8/2007 Yang et al.
2007/0205195 A1 9/2007 Yang et al.
2007/0209846 A1 9/2007 Wilson
2007/0215622 A1 9/2007 Perez
2007/0241109 A1 10/2007 Lin
2007/0266637 A1 11/2007 McGowan
2007/0272691 A1 11/2007 Wang et al.
2007/0289972 A1 12/2007 Wynn et al.
2008/0011754 A1 1/2008 Ramsey
2008/0011910 A1 1/2008 Ramsey
2008/0041863 A1 2/2008 Forest
2008/0083756 A1 4/2008 Daniels
2008/0099274 A1 5/2008 Seel
2008/0128428 A1* 6/2008 Beckerman ..... 220/532
2008/0164257 A1 7/2008 Boll et al.
2008/0236275 A1 10/2008 Breed et al.
2008/0237234 A1 10/2008 Yang et al.
2008/0257889 A1 10/2008 Kovacevich et al.
2008/0257890 A1 10/2008 Kovacevich et al.
2008/0257891 A1 10/2008 Kovacevich et al.
2008/0264948 A1 10/2008 Kovacevich et al.
2008/0264950 A1 10/2008 Kovacevich et al.
2008/0272119 A1 11/2008 Efstathiou
2008/0272127 A1 11/2008 Kovacevich et al.
2009/0084788 A1 4/2009 Yang et al.
2009/0136341 A1 5/2009 Kenyon
2009/0194532 A1 8/2009 Yang et al.
2009/0230131 A1 9/2009 McDuffie et al.
2009/0261105 A1 10/2009 Cunningham et al.
2009/0266836 A1 10/2009 Mobley
2010/0006572 A1 1/2010 Chiou
2010/0084235 A1 4/2010 Lu
2010/0096894 A1 4/2010 Fukai
2010/0122985 A1 5/2010 Peters et al.
2010/0147865 A1 6/2010 Yang et al.
2010/0170904 A1 7/2010 Kalman et al.
2010/0224627 A1 9/2010 Yang et al.
2010/0237074 A1 9/2010 Yang et al.
2010/0252557 A1 10/2010 Clements
2010/0294769 A1 11/2010 Lee et al.
2011/0017735 A1 1/2011 Wang et al.
2011/0049149 A1 3/2011 Shih
2011/0139781 A1 6/2011 Jin et al.
2011/0220646 A1 9/2011 Yang et al.
2011/0220647 A1 9/2011 Yang et al.
2011/0220648 A1 9/2011 Yang et al.
2011/0272409 A1 11/2011 Kasbohm
2012/0234849 A1 9/2012 Hughes et al.
2013/0098913 A1 4/2013 Yang et al.
2013/0105487 A1 5/2013 Baik
2013/0233853 A1 9/2013 Yang et al.
2013/0233857 A1 9/2013 Yang et al.
2013/0240592 A1 9/2013 Woodruff
2013/0248532 A1 9/2013 Yang et al.

(56) References Cited

U.S. PATENT DOCUMENTS

| | | | |
|---|---|---|---|
| 2013/0248535 | A1 | 9/2013 | Wolfe et al. |
| 2013/0300119 | A1 | 11/2013 | Anzalon et al. |
| 2014/0183193 | A1 | 7/2014 | Hammond et al. |
| 2014/0246432 | A1 | 9/2014 | Yang et al. |
| 2014/0246434 | A1 | 9/2014 | Yang et al. |
| 2014/0345453 | A1 | 11/2014 | Oh et al. |
| 2015/0251849 | A1 | 9/2015 | Yang et al. |
| 2015/0259139 | A1 | 9/2015 | Yang et al. |
| 2015/0259140 | A1 | 9/2015 | Yang et al. |

FOREIGN PATENT DOCUMENTS

| | | | |
|---|---|---|---|
| CA | 2519295 | | 3/2007 |
| CA | 132181 | | 6/2010 |
| CA | 136938 | | 5/2011 |
| CA | 141819 | | 4/2012 |
| CA | 146601 | | 2/2013 |
| CA | 152797 | | 4/2014 |
| CA | 158595 | | 4/2015 |
| CA | 158685 | | 4/2015 |
| CN | 102190144 | A | 9/2011 |
| CN | 301947175 | S | 6/2012 |
| CN | 103300590 | A | 9/2013 |
| CN | 302771721 | S | 3/2014 |
| CN | ZL 201330418089.X | | 3/2014 |
| CN | 104016030 | A | 9/2014 |
| CN | 303188855 | S | 4/2015 |
| CN | 303206241 | S | 5/2015 |
| DE | 1610087 | | 6/1950 |
| DE | 822376 | | 11/1951 |
| DE | 1283741 | | 7/1966 |
| DE | 8436939 | | 3/1985 |
| DE | 9108341 | | 10/1991 |
| DE | 4225936 | A1 | 2/1994 |
| DE | 19525885 | | 3/1997 |
| DE | 19617823 | | 11/1997 |
| DE | 19809331 | | 5/1999 |
| DE | 29918687 | | 3/2000 |
| DE | 19933180 | | 1/2001 |
| DE | 10148997 | | 4/2003 |
| DE | 20217561 | | 3/2004 |
| EP | 0582240 | | 7/1993 |
| EP | 0903305 | A1 | 3/1999 |
| EP | 0906876 | | 4/1999 |
| EP | 1094017 | | 4/2001 |
| EP | 1361176 | | 11/2003 |
| EP | 1136393 | | 4/2004 |
| EP | 1447342 | A2 | 8/2004 |
| EP | 1600373 | A2 | 11/2005 |
| EP | 1647503 | A1 | 4/2006 |
| EP | 1686073 | | 8/2006 |
| EP | 1918223 | A1 | 5/2008 |
| EP | 1700799 | B1 | 8/2009 |
| EP | 001164826-0001 | | 9/2009 |
| EP | 001232904-0001 | | 10/2010 |
| EP | 2343250 | A1 | 7/2011 |
| EP | 001908575-0001 | | 8/2011 |
| EP | 001317416-0001 | | 4/2012 |
| EP | 001317416-0002 | | 4/2012 |
| EP | 001335285-0001 | | 7/2012 |
| EP | 001335293-0001 | | 7/2012 |
| EP | 001381636-001 | | 8/2013 |
| EP | 001381792-0001 | | 8/2013 |
| EP | 2636611 | A1 | 9/2013 |
| EP | 2636613 | A1 | 9/2013 |
| EP | 001420590-0001 | | 9/2014 |
| EP | 2772454 | A2 | 9/2014 |
| EP | 2915763 | A1 | 9/2015 |
| EP | 2918518 | A2 | 9/2015 |
| EP | 002766782-0001 | | 11/2015 |
| EP | 002766782-0002 | | 11/2015 |
| EP | 002766881-0001 | | 11/2015 |
| FR | 2887152 | | 12/2006 |
| GB | 191004921 | | 6/1910 |
| GB | 2384418 | | 7/2003 |
| JP | 02 152670 | | 6/1990 |
| JP | H06-56011 | | 8/1994 |
| JP | 06-272888 | | 9/1994 |
| JP | D1300450 | | 5/2007 |
| JP | D1300451 | | 5/2007 |
| JP | D1322056 | | 2/2008 |
| JP | D1398668 | | 10/2010 |
| KR | 3003841370000 | | 6/2005 |
| KR | 3004095430000 | | 3/2006 |
| KR | 3004095430001 | | 7/2006 |
| NL | 6908550 | | 12/1970 |
| TW | D112733 | | 9/2006 |
| TW | D129485 | | 7/2009 |
| TW | D133382 | | 2/2010 |
| TW | D133678 | | 3/2010 |
| TW | D147147 | | 5/2012 |
| TW | D154797 | | 7/2013 |
| TW | D158187 | | 1/2014 |
| TW | D161587 | | 7/2014 |
| TW | D168957 | | 7/2015 |
| TW | D170334 | | 9/2015 |
| TW | 201538406 | | 10/2015 |
| WO | WO 92/02430 | | 2/1992 |
| WO | WO 96/33671 | | 10/1996 |
| WO | WO 2005/080232 | A1 | 9/2005 |
| WO | WO 2006-079263 | | 8/2006 |
| WO | WO 2007/139570 | | 12/2007 |
| WO | WO 2009/114495 | | 9/2009 |
| WO | WO 2015/134902 | A1 | 9/2015 |
| WO | WO 2015/138625 | A1 | 9/2015 |

OTHER PUBLICATIONS

U.S. Appl. No. 29/411,482, filed Jan. 20, 2012.
U.S. Appl. No. 29/411,490, filed Jan. 20, 2012.
U.S. Appl. No. 29/411,491, filed Jan. 20, 2012.
European Search Report for Application No. EP 10002273, dated Jan. 4, 2011, in 9 pages.
European Search Report for European Application No. EP 06010394, dated Aug. 24, 2006, in 1 page.
Partial European Search Report for Application No. EP 10002273, dated Jul. 2, 2010, in 4 pages.
Search Report for Taiwan Design Patent Application No. 097304453, dated Apr. 22, 2009.
Search Report for Taiwan Design Patent Application No. 099304439, dated Jul. 1, 2011, in 1 page.
Trento Corner 23 Trash Can, Hailo product brochure, http://www.hailo.de/html/default.asp?site=12_71_107&lang=en.
U.S. Appl. No. 14/637,270, filed Mar. 4, 2015, Yang et al.
U.S. Appl. No. 14/639,049, filed Mar. 4, 2015, Yang et al.
U.S. Appl. No. 14/639,862, filed Mar. 5, 2015.
U.S. Appl. No. 29/519,549, filed Mar. 5, 2015.
U.S. Appl. No. 29/519,551, filed Mar. 5, 2015.
U.S. Appl. No. 13/783,149, filed Mar. 1, 2013, Yang et al.
U.S. Appl. No. 29/447,313, filed Mar. 1, 2013, Yang et al.
U.S. Appl. No. 29/484,903, filed Mar. 13, 2014, Yang et al.
U.S. Appl. No. 29/484,764, filed Mar. 1, 2013, Yang et al.
U.S. Appl. No. 14/198,460, filed Mar. 5, 2014, Yang et al.
U.S. Appl. No. 14/856,309, filed Sep. 26, 2015.
U.S. Appl. No. 29/548,018, filed Dec. 9, 2015, Yang et al.
U.S. Appl. No. 29/557,032, filed Mar. 4, 2016, Yang et al.
U.S. Appl. No. 29/557,088, filed Mar. 4, 2016, Yang et al.

* cited by examiner

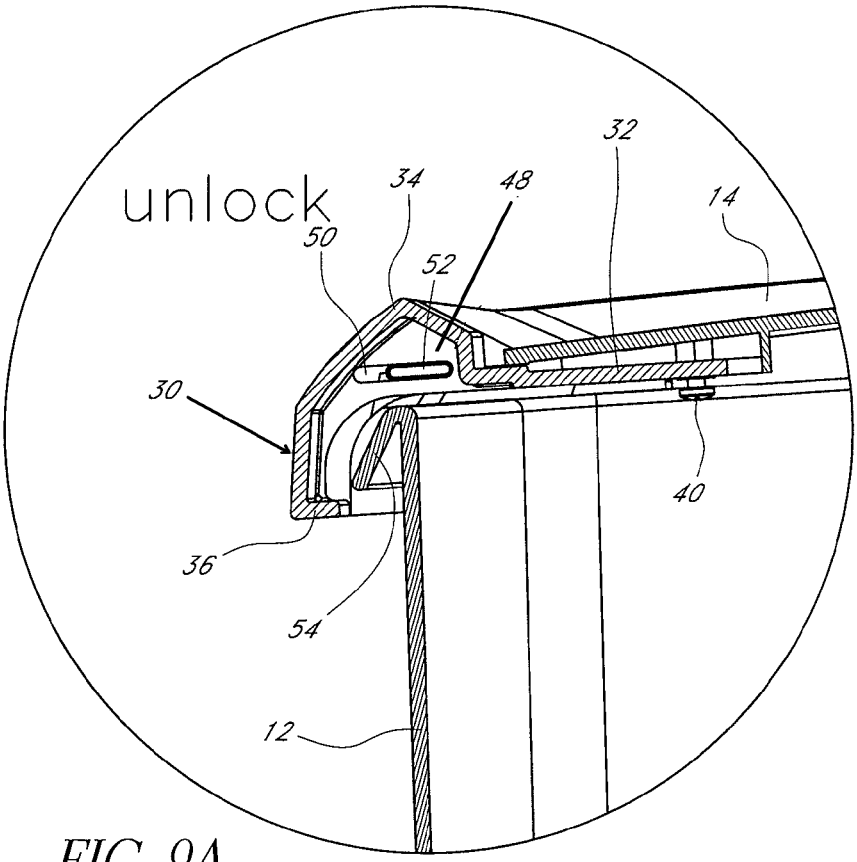
FIG. 9A
FIG. 9B
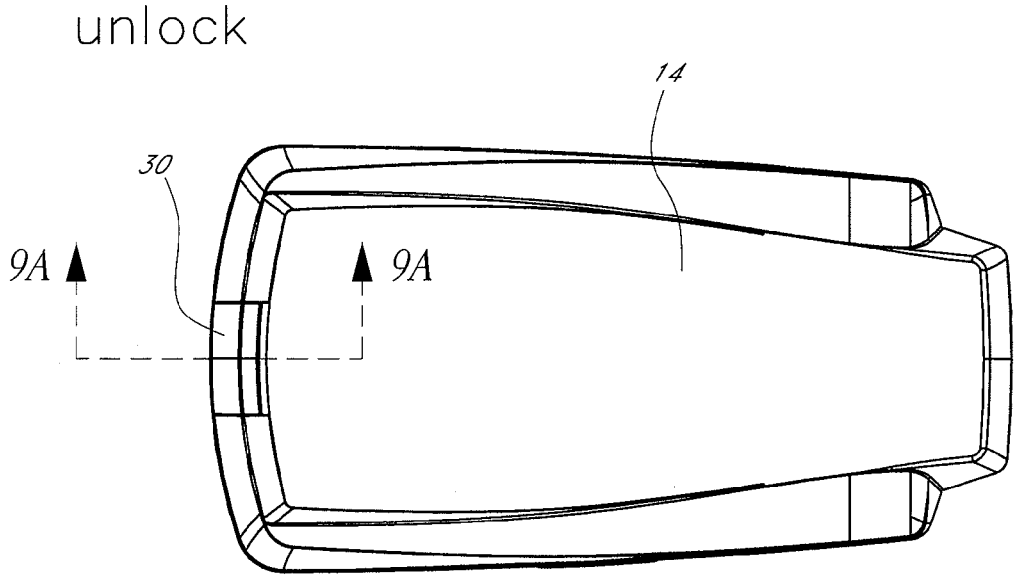

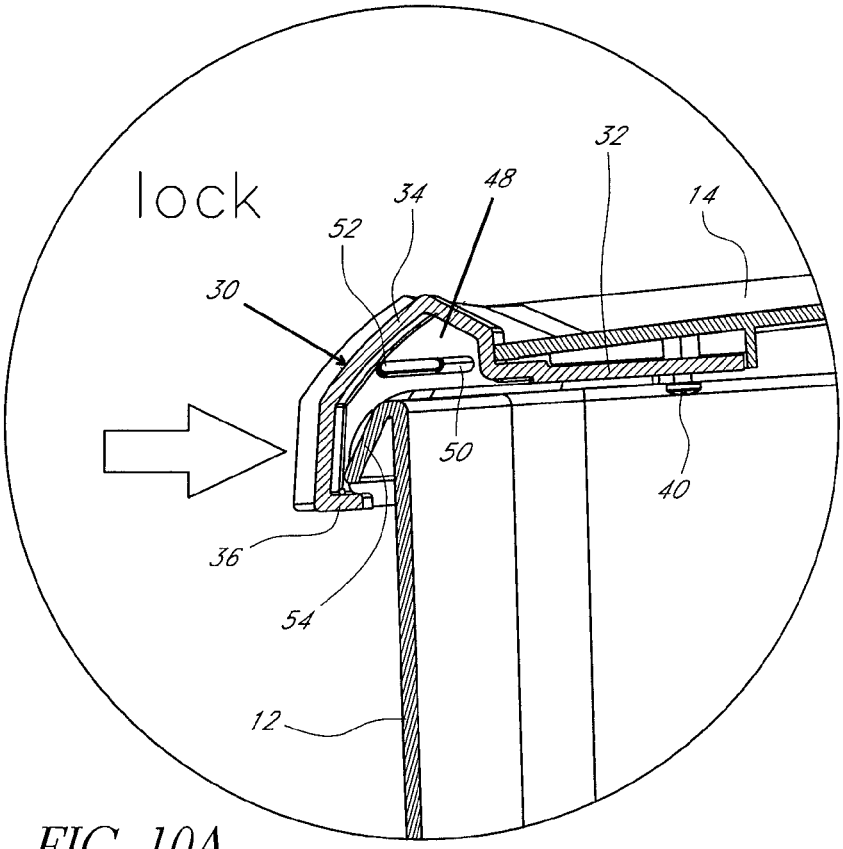
FIG. 10A
FIG. 10B
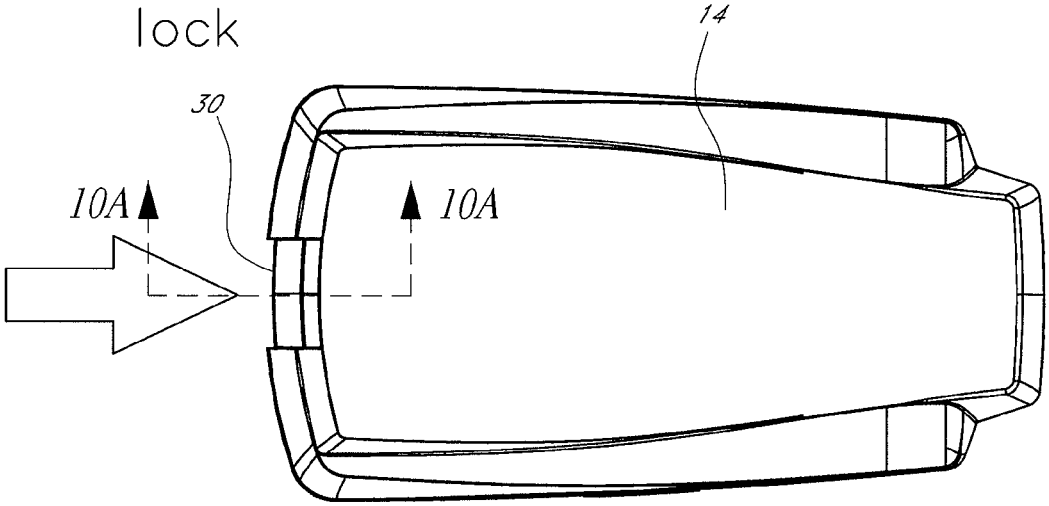

TRASH CAN

RELATED APPLICATIONS

This application claims benefit under 35 U.S.C. §119(e) to U.S. Provisional Patent Application No. 61/313,679, filed Mar. 12, 2010, which is incorporated in its entirety by reference herein. U.S. Patent Application No. 60/906,071, filed Mar. 9, 2007, and U.S. patent application Ser. No. 12/045,641, filed Mar. 10, 2008, are each incorporated in their entireties by reference herein.

BACKGROUND OF THE INVENTIONS

1. Field of the Inventions

The present inventions are directed to trashcans.

2. Description of the Related Art

Receptacles and other devices having lids or doors are used in a variety of different settings. For example, in both residential and commercial settings, trashcans and other devices often have lids or doors for protecting or preventing the escape of the contents of the receptacle. In the context of trashcans, some trashcans include lids or doors to prevent odors from escaping and to hide the trash within the receptacle from view. Additionally, the lid of a trashcan helps prevent contamination from escaping from the receptacle.

Recently, trashcans with rotary-type motion dampers for slowing the motion of the lids have become commercially available. More specifically, these rotary dampening mechanisms are connected to the lids of the trashcans so as to slow the closing movement of the lids. As such, the trashcan is more aesthetically pleasing because the lid closes slowly, thereby preventing a loud slamming noise when the lid is moved to a closing position.

Further, these types of trashcans often are pedal-actuated, i.e., they include a foot pedal which is connected to the lid for moving the lid toward the open position. The rotary mechanisms are connected to the internal linkage connecting the foot pedal to the lid so as to slow the closing movement of the lid.

SUMMARY OF THE INVENTIONS

An aspect of at least one of the embodiments disclosed herein includes the realization that including a pivotable pedal protector can in some embodiments not only provide a stabilizing force to prevent the trash can from tipping over, but can also facilitate stacking of trashcans for shipping and/or storage. Another aspect of at least one of the embodiments disclosed herein includes the realization that including a notch or notches on the body or liner of a trashcan can facilitate insertion of more than one trash bag. Furthermore, providing a divider can further help separate a trash can, and facilitate more than one trash bag inside the trash can.

Thus, in accordance with an embodiment, a trashcan can comprise a body defining an interior cavity configured to receive trash, the trash can body having at least one upper opening through which trash can be inserted into the interior cavity, a lid pivotally attached to the trash can body so as to move between opened position and closed positions, a lid actuating system comprising a pedal and at least one linkage connecting the pedal with the lid, such that movement of the pedal causes opening and closing movement of the lid, a lid latch supported by the lid, the lid latch comprising a slidable member mounted so as to be slidable relative to the lid, the lid latch being slidable from a first position in which the lid latch engages a ledge of the trash can body so as to lock the lid in a closed position and a second position in which the lid latch does not engage the ledge of the trash can body, a mounting platform connected to the body, a damping mechanism connected to the mounting platform and to at least one of the linkages and pedal, the damping mechanism configured to dampen movement of the lid in at least one of an opening and closing motion, at least one notch along the body for insertion of a trash bag, a plurality of divider holding components located along the interior cavity, a divider connected to the plurality of divider components, the divider dividing the interior cavity into a plurality of cavities for receiving trash, and a pedal protector pivotably coupled to the body, the pedal protector configured to pivot from a first position near the pedal to a second position away from the pedal.

In accordance with another embodiment, a trashcan can comprise a body defining an interior cavity configured to receive trash, the trashcan body having at least one upper opening through which trash can be inserted into the interior cavity, a lid pivotally attached to the trashcan body so as to move between opened position and closed positions, a lid actuating system comprising a pedal and at least one linkage connecting the pedal with the lid, such that movement of the pedal causes opening and closing movement of the lid, at least one notch along the body for insertion of a trash bag, a plurality of divider holding components located along the interior cavity, and a divider connected to the plurality of divider components, the divider dividing the interior cavity into a plurality of cavities for receiving trash, the divider comprising a plurality of divider connection members having elongate members with I-beam configurations configured to be received within the divider holding components.

In accordance with yet another embodiment, a trashcan can comprise a body defining an interior cavity configured to receive trash, the trashcan body having at least one upper opening through which trash can be inserted into the interior cavity, a lid pivotally attached to the trashcan body so as to move between opened position and closed positions, a lid actuating system comprising a pedal and at least one linkage connecting the pedal with the lid, such that movement of the pedal causes opening and closing movement of the lid, and a pedal protector pivotably attached to the body.

BRIEF DESCRIPTION OF THE DRAWINGS

These and other features and advantages of the present embodiments will become more apparent upon reading the following detailed description and with reference to the accompanying drawings of the embodiments, in which:

FIG. 9A is a detail sectional view of the step trashcan taken along line 9A-9A in FIG. 9B with a lid latch in an unlocked position;

FIG. 9B is a top plan view of the lid with the lid latch in the unlocked position;

FIG. 10A is a detail sectional view of the step trashcan taken along line 10A-10A in FIG. 10B, with the lid latch in a locked position;

FIG. 10B is a top plan view of the lid with the lid latch in the locked position.

DETAILED DESCRIPTION OF THE PREFERRED EMBODIMENTS

The inventions disclosed herein are disclosed in the context of a trashcan because they have particular utility in this context. However, the inventions disclosed herein can be used in other contexts as well. Further, the inventions are described herein in reference to various embodiments and drawings. It will be appreciated by those skilled in the art that variations and improvements may be accomplished in view of these teachings without deviating from the scope and spirit of the invention. By way of illustration, the present inventions are described in reference to a step-type trash container, or a step trashcan of the kind typically used in kitchens, for example. Other types of trash containers, with pivoted lids or removable lids can be used in connection with the present inventions.

Figure 1:
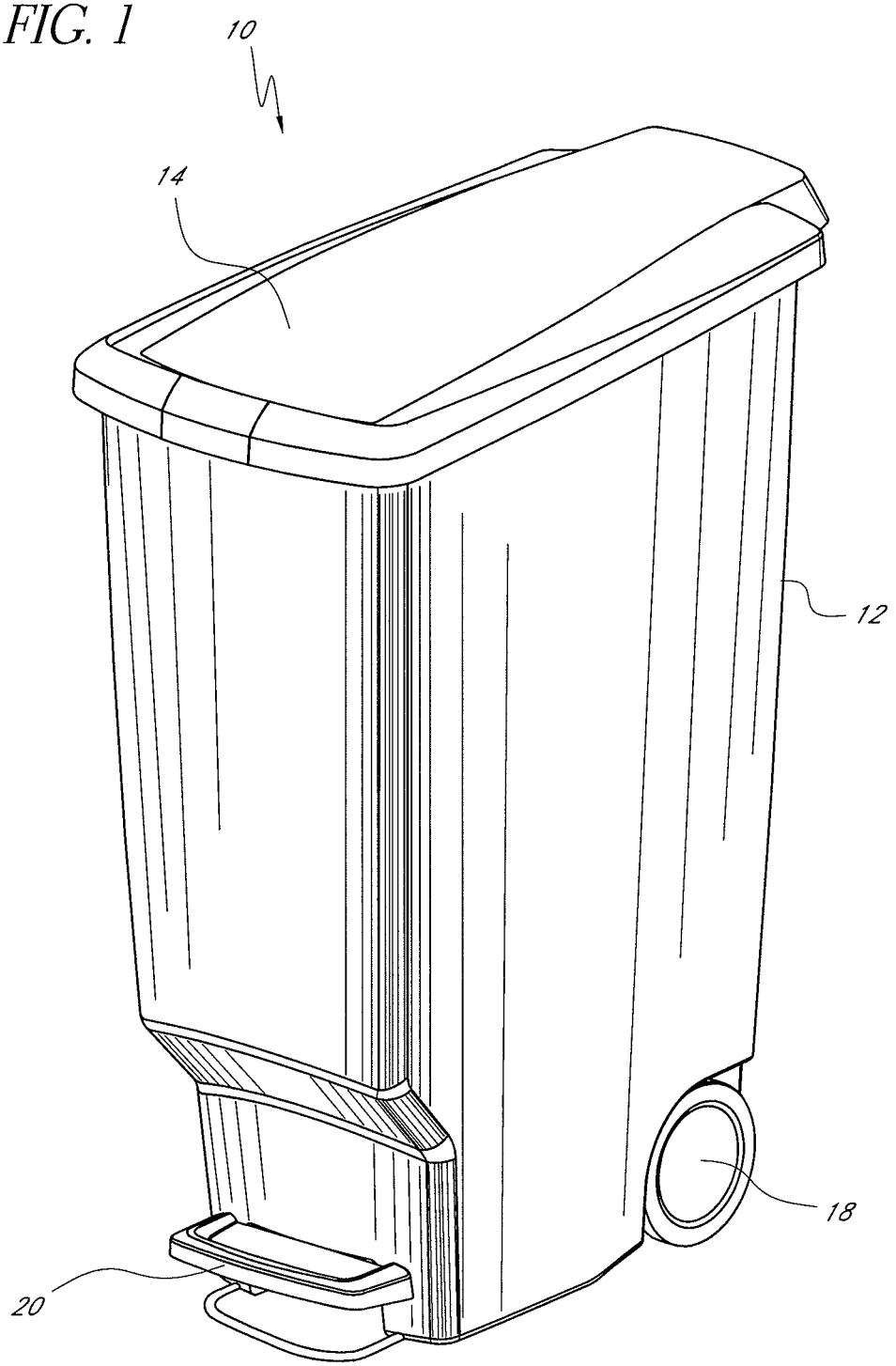
FIG. 1 is a right perspective view of a step trashcan in accordance with an embodiment.
Figure 2:
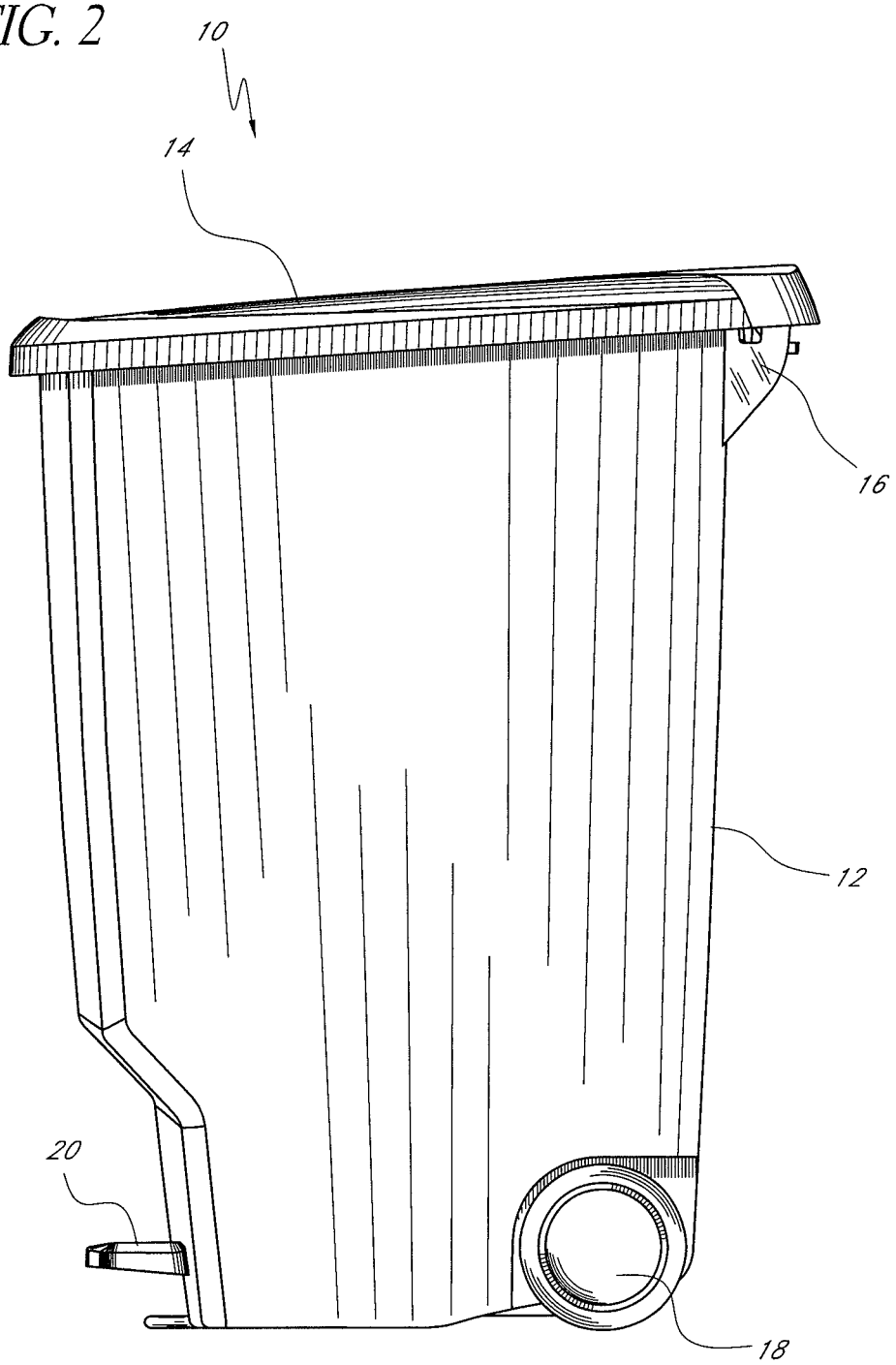
FIG. 2 is a left side view thereof.
Figure 3:
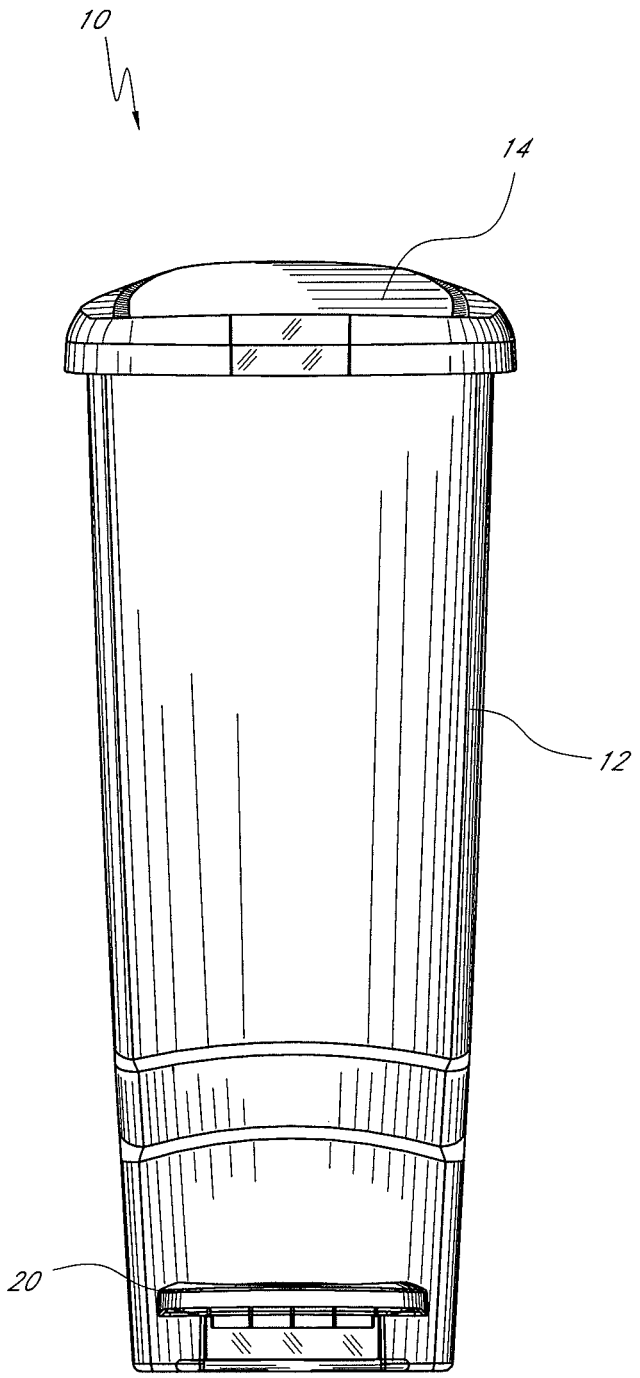
FIG. 3 is a front view thereof.

With reference to FIGS. 1-3, a step trashcan 10 can generally have a body 12 defining an interior cavity configured to receive trash, and a lid 14 pivotally supported relative to the body 12. For example, the lid 14 can be hinged to a rear top edge of the body 12 by a hinge member 16 as shown in FIG. 2. A pair of wheels 18, provided along the bottom of the trashcan 10, can be provided to facilitate moving the step trashcan 10 along a rolling surface.

Figure 4:
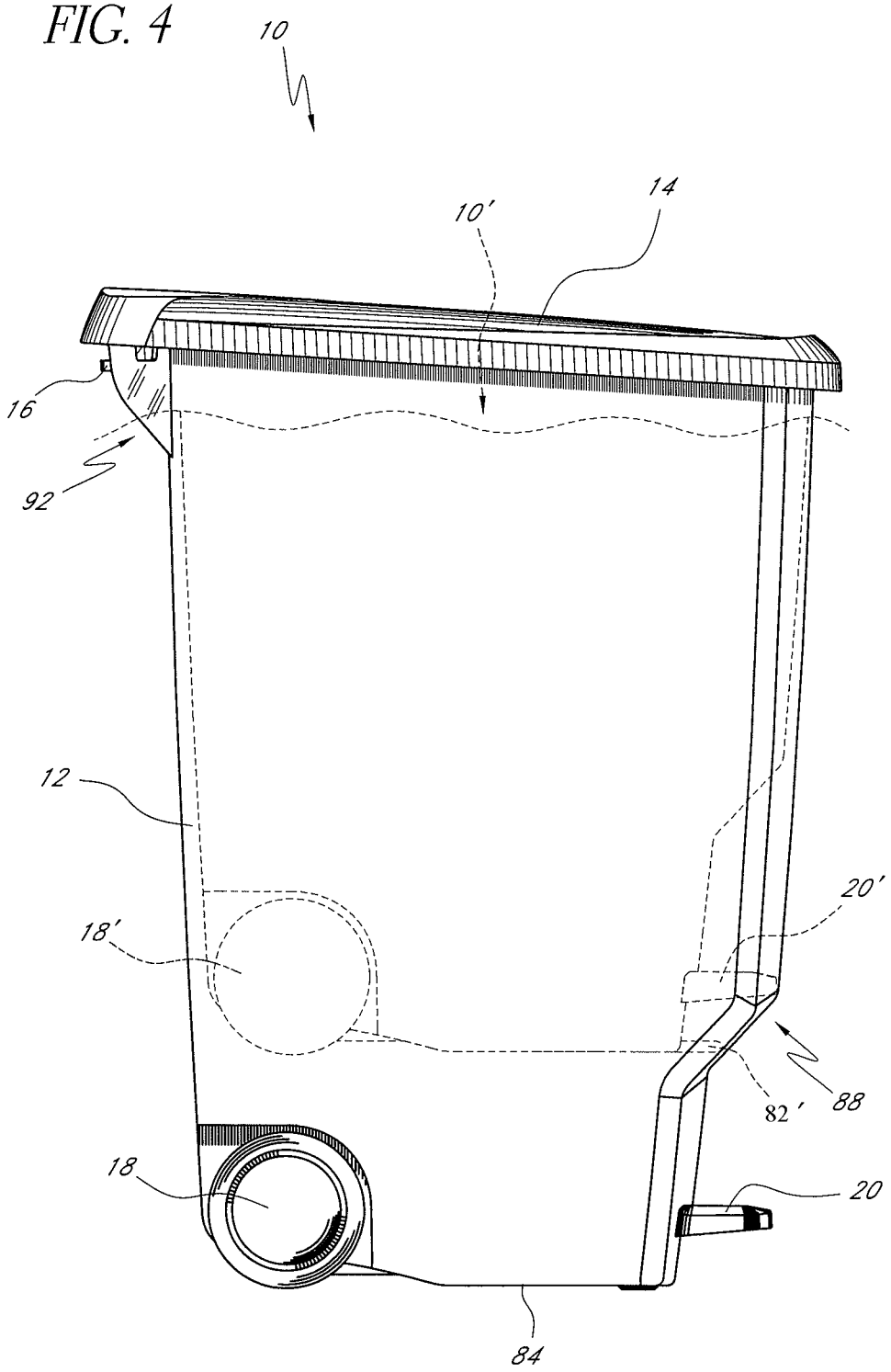
FIG. 4 is a right side view thereof.
Figure 5:
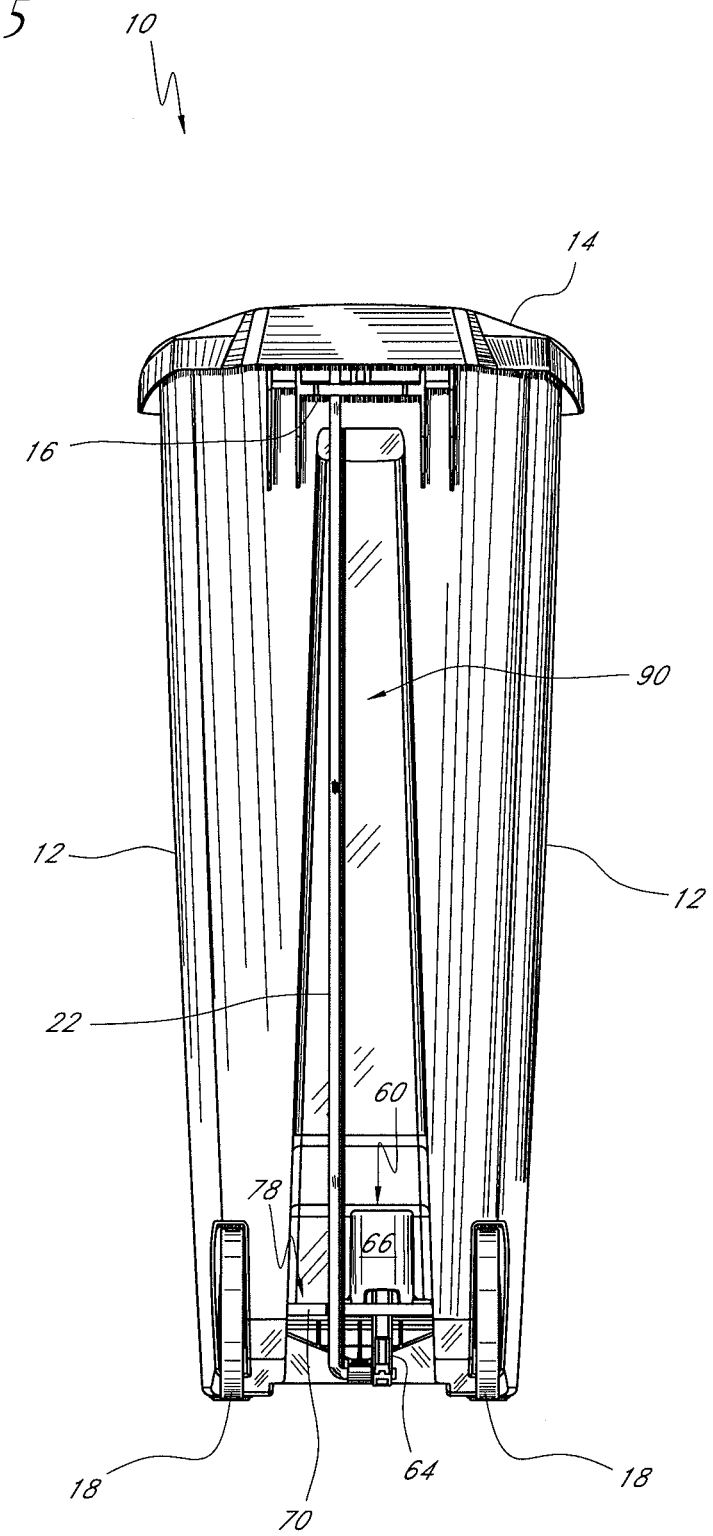
FIG. 5 is a rear view thereof.
Figure 6:
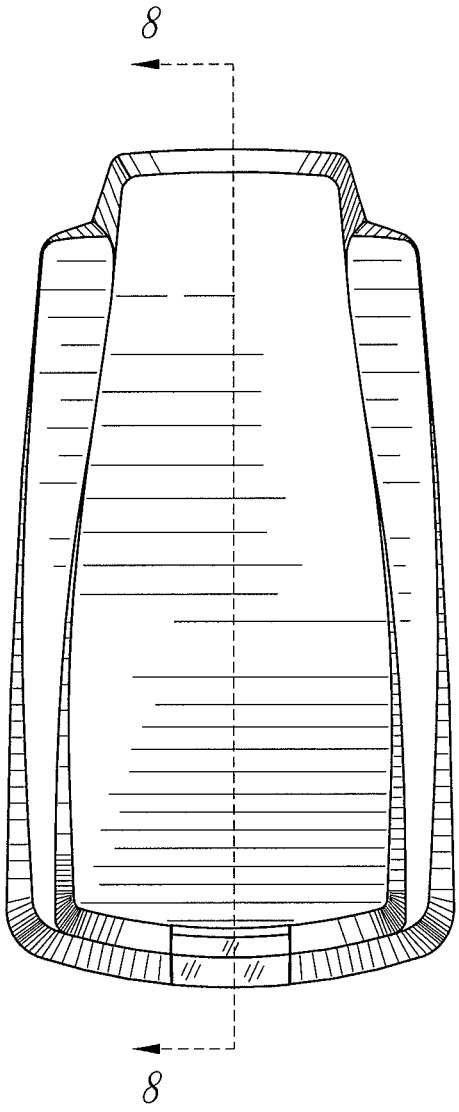
FIG. 6 is a top plan view thereof.
Figure 7:
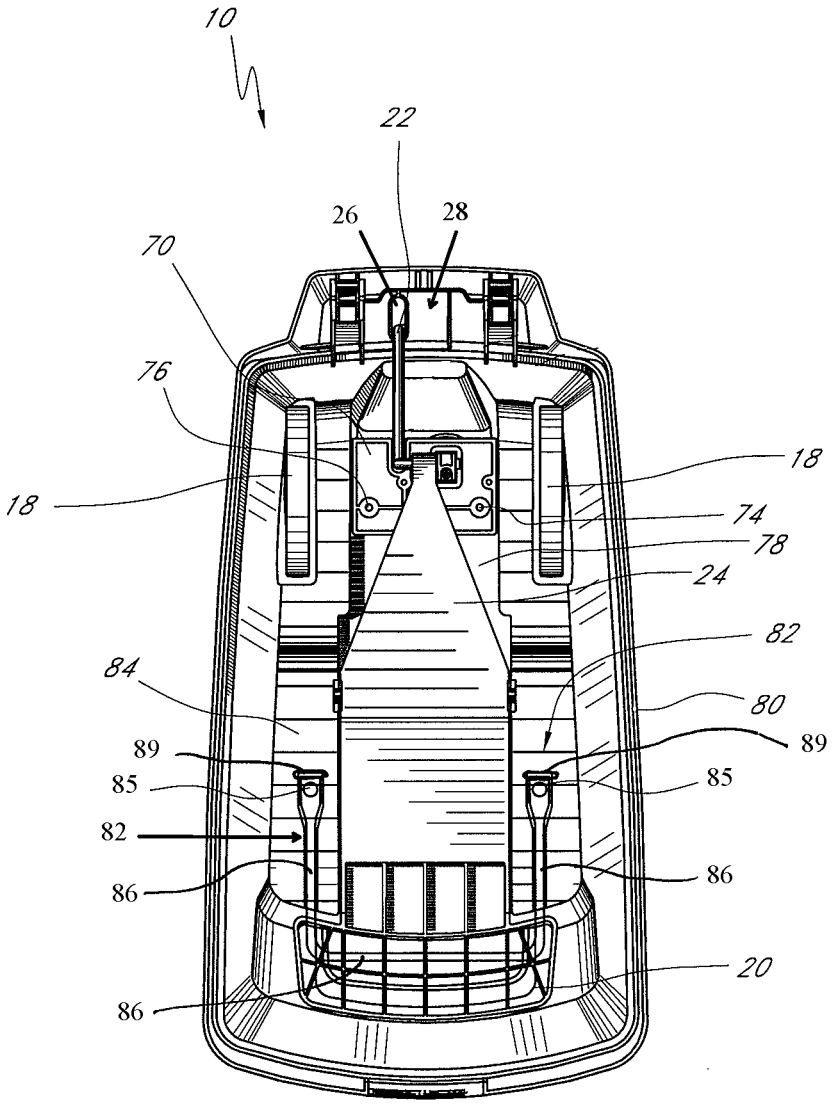
FIG. 7 is a bottom plan view thereof.
Figure 8:
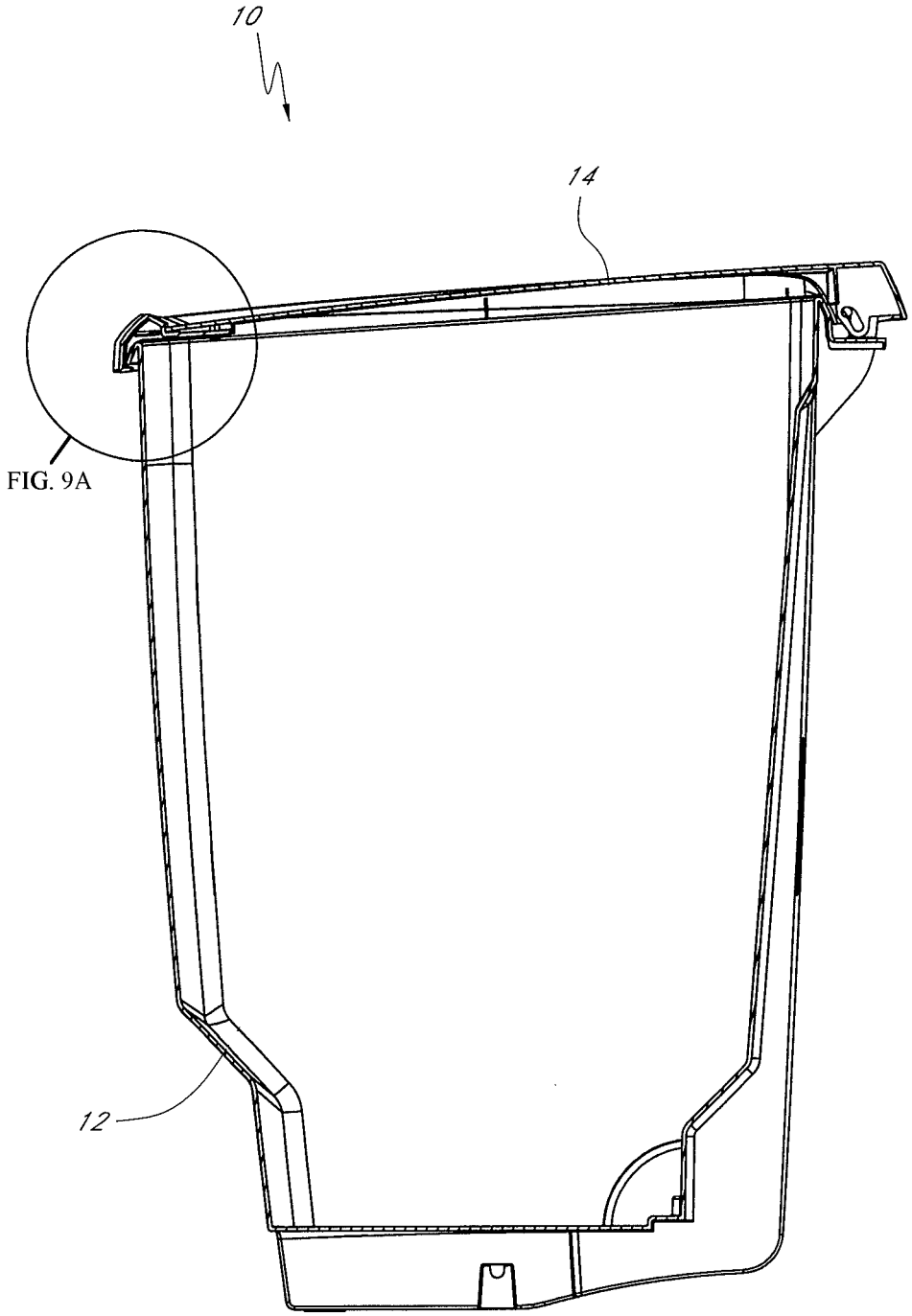
FIG. 8 is a sectional view taken along line 8-8 in FIG. 6.

With reference to FIGS. 4, 5, and 7, a lid actuator system (e.g. opening mechanism) can be provided along the top of the step trashcan 10 to activate pivotal opening of the lid 14. The lid actuator system can include a foot piece (or "pedal") 20. The pedal 20 can be located, for example, near a lower front portion of the body 12, though other locations are also possible. The lid actuator system can include linkages 22 (see FIGS. 5 and 7) and a lever member 24 (see FIG. 7), that can cooperate to move the lid 14 from a closed to an open position. In some embodiments, and with continued reference to FIG. 7, at least one linkage 22 can extend through an opening 26 along a back portion 28 of the trashcan 10. Other lid actuator systems known in the art can be deployed without departing from the scope and spirit of the present inventions.

In some embodiments, and with reference to FIGS. 8-16, the lid 14 can include a lid latch 30, which can for example be integrated into or self-contained in the lid 14 (e.g. as opposed to a separate external locking piece for the lid). In some embodiments, the lid latch 30 can be configured to slide with respect to an edge of the opening of the body 12 from an unlocked position to a locked position. A sliding support interface between the lid latch 30 and the lid 14 can be provided with structures (e.g., indent and complementary locking tabs) that positively index the lid latch 30 in the locked and unlocked positions. However, other configurations can also be used.

FIGS. 9, 11, 13 and 15 illustrate an embodiment of the lid latch 30 in the opened/unlocked position, and FIGS. 10, 12, 14 and 16 illustrate the lid latch 30 in the closed/locked position. FIGS. 9-16 overall illustrate various views of the sliding movements of the lid latch 30 with respect to the body 12, from the open/unlocked position to a closed/locked position.

Figure 11:
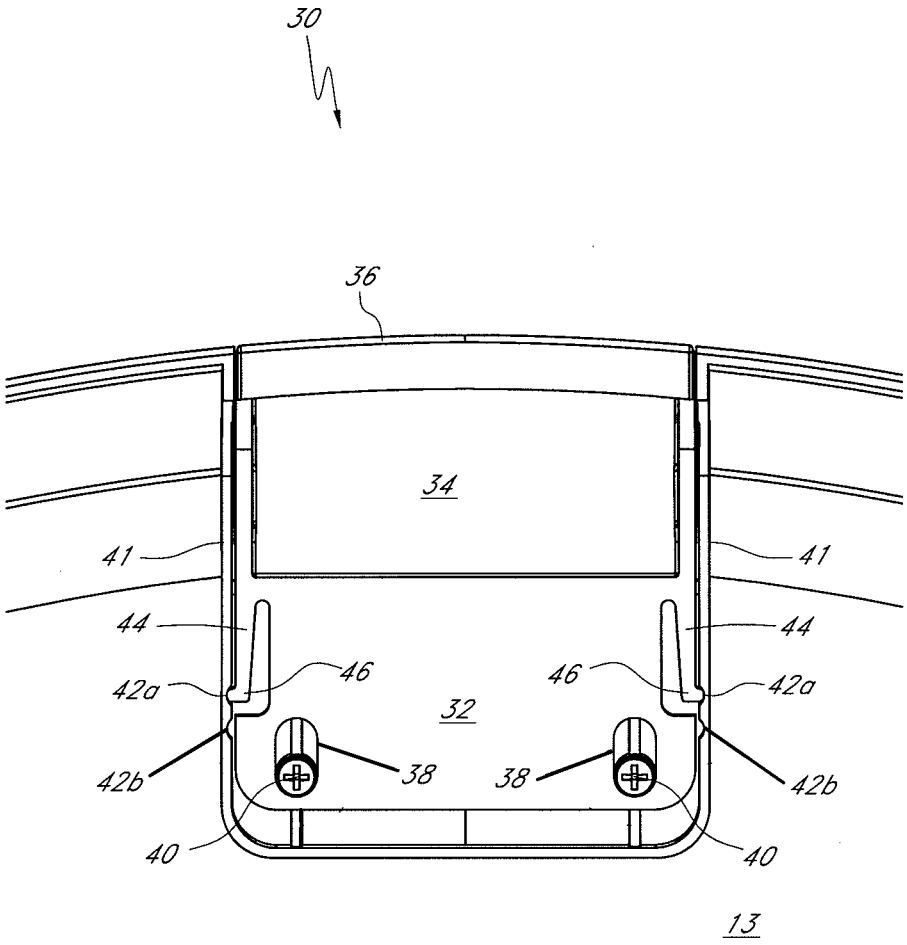
FIG. 11 is a plan view of the underside of the lid with the latch in the unlocked position.
Figure 12:
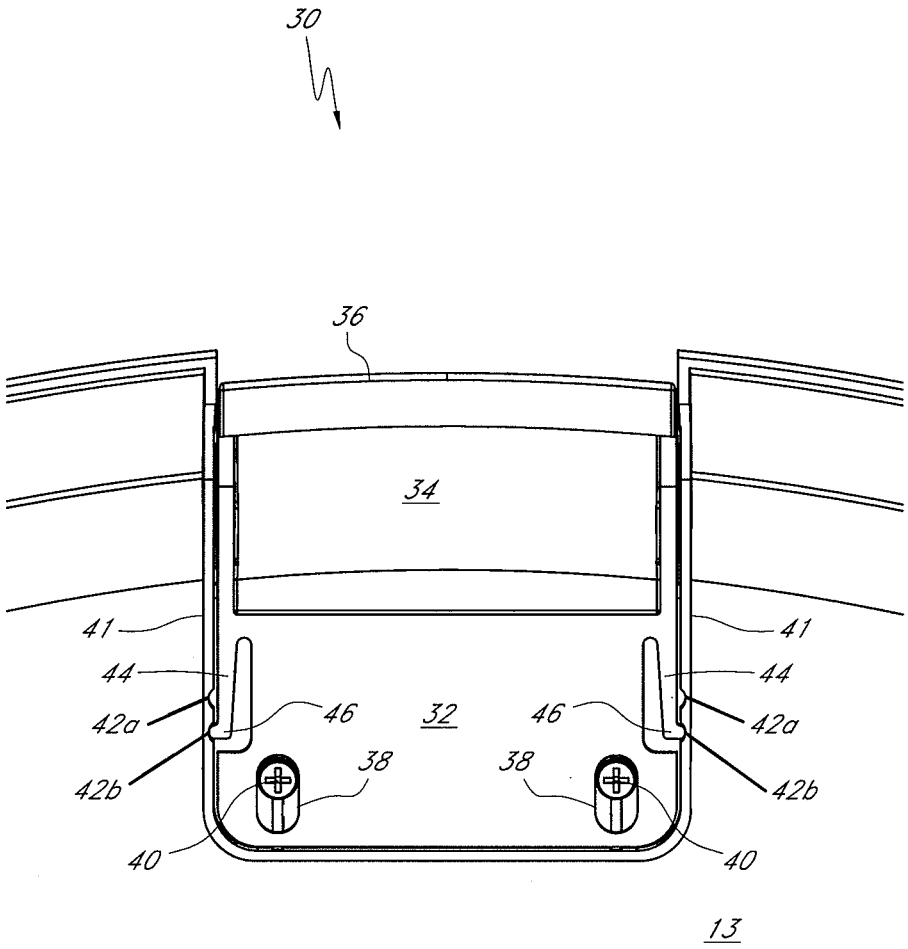
FIG. 12 is a plan view of the underside of the lid with the lid latch in the locked position.
Figure 13:
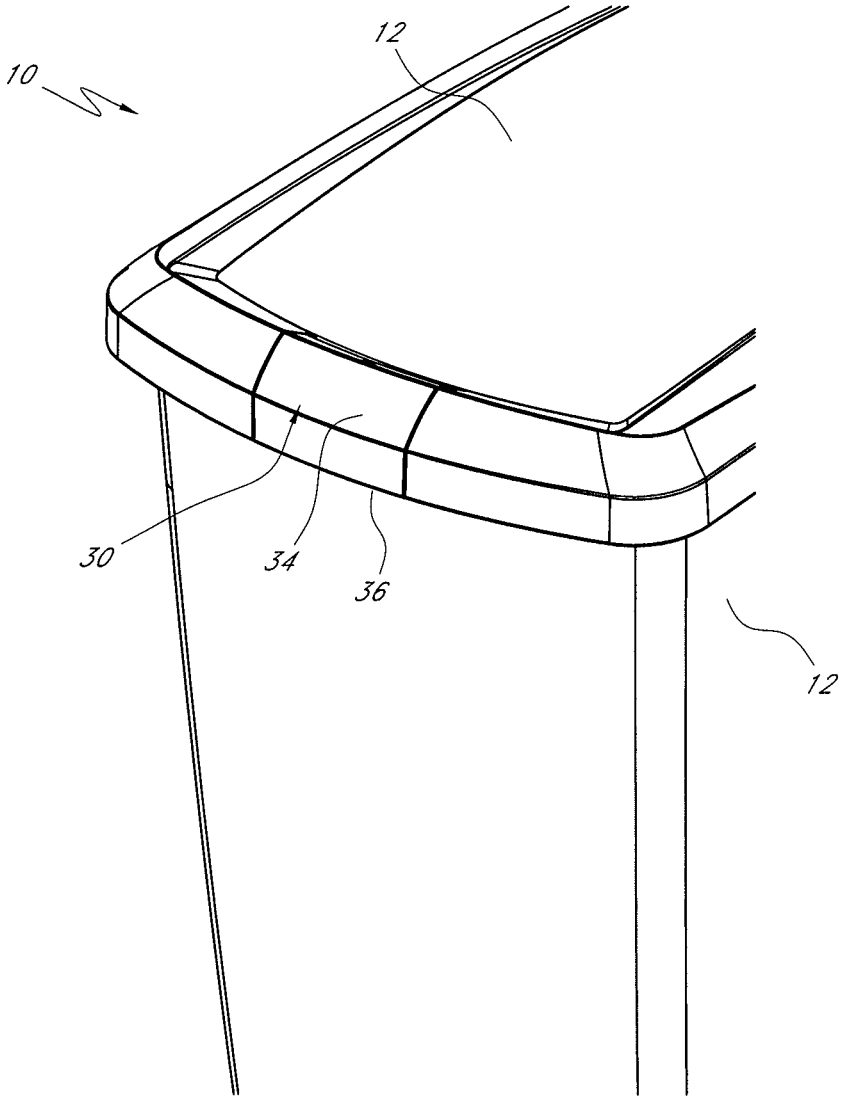
FIG. 13 is a top perspective view of the lid with the lid latch in the unlocked position.
Figure 14:
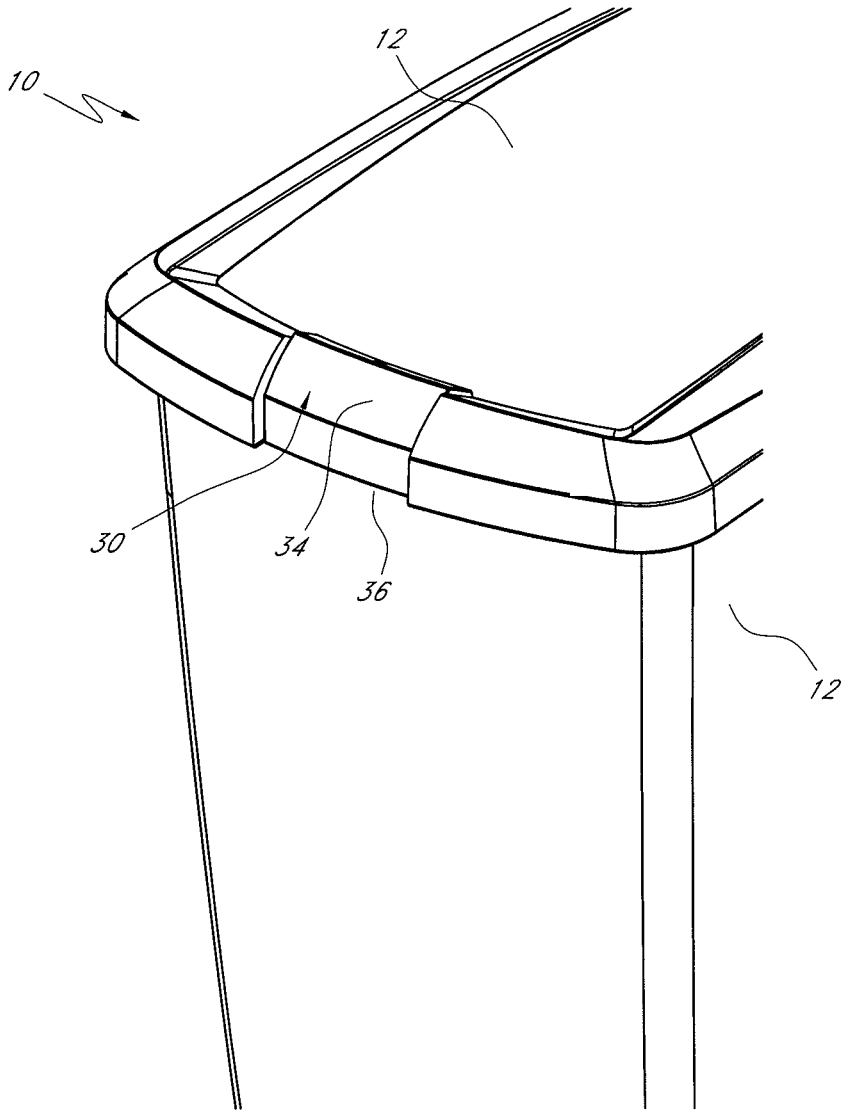
FIG. 14 is a top perspective view of the lid with the lid latch in the locked position.
Figure 15:
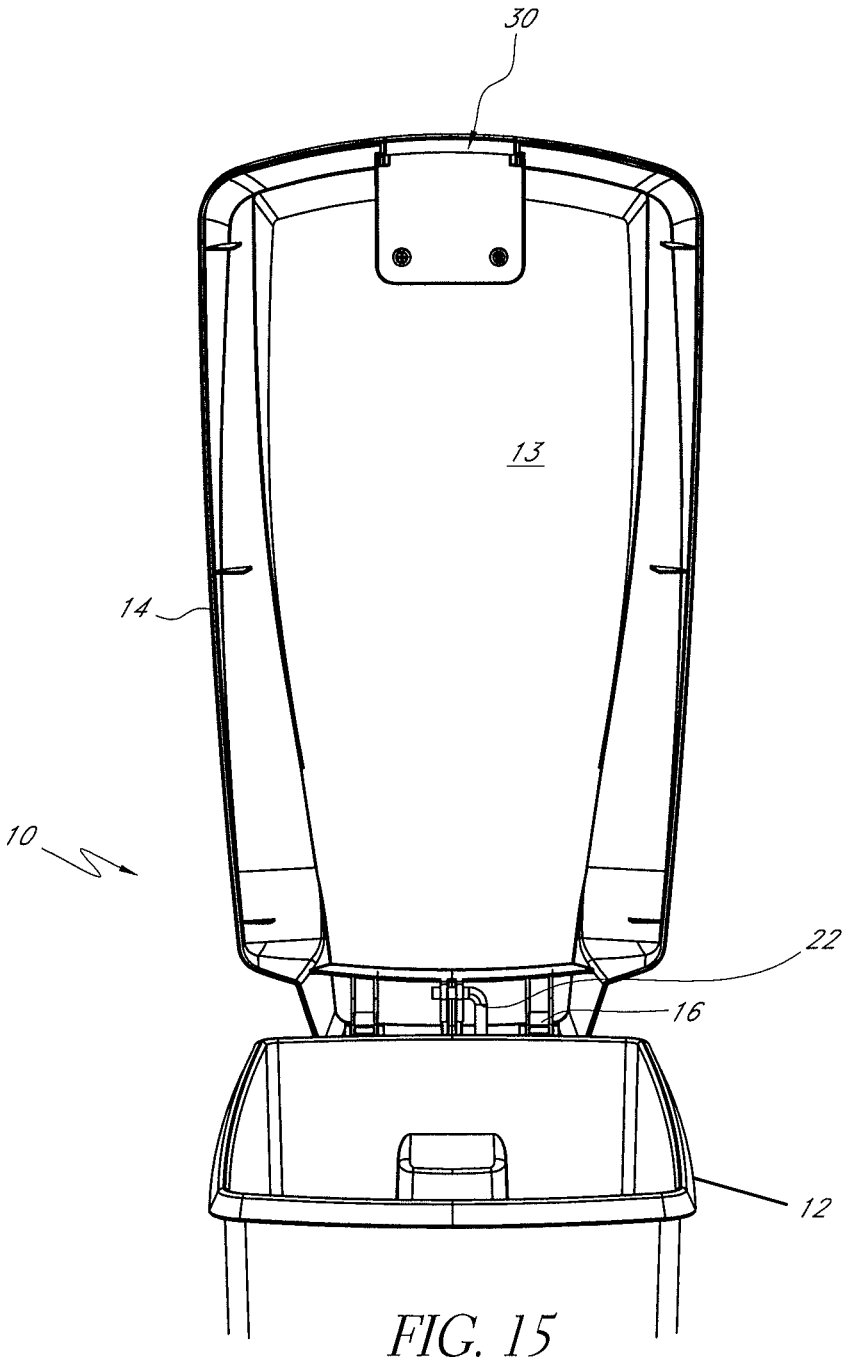
FIG. 15 is a front perspective view of the step trashcan with the lid open, showing the underside of the lid with the lid latch in the unlocked position.
Figure 16:
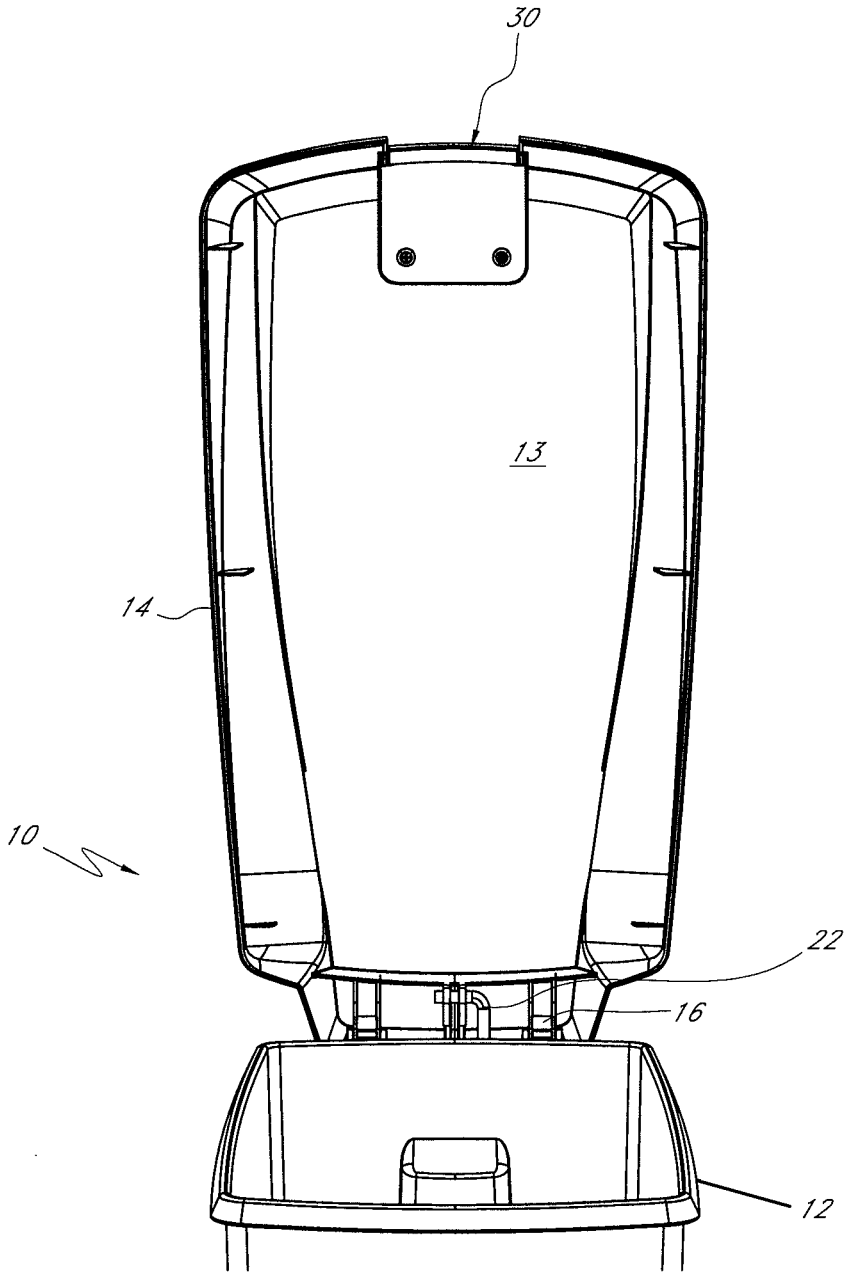
FIG. 16 is a front perspective view of the step trashcan with the lid open, showing the underside of the lid with the lid latch in the locked position.

Referring to FIGS. 9A, 10A, and 11-14, in some embodiments the lid latch 30 can comprise a plate section 32, a bent section 34, and a lip 36. The bent section 34 can be exposed externally, as illustrated in FIG. 13, and can have a profile that is generally flush with the profile of the adjacent structure of the lid 14 when in the unlocked or locked position, thereby providing an aesthetically pleasing and appealing structure. With reference to FIGS. 11 and 12, the plate section 32 can be provided with two slotted holes 38. The plate section 32 can be slidably attached to an underside 13 of the lid 14 by two retaining screws 40 anchored to the underside 13 of the lid 14, and extending at least in part through the two slotted holes 38.

The slotted holes 38 can be sized to allow the screws 40 to slide relatively within the slotted holes 38, thereby allowing the plate section 32 to slide relative to the lid 14, from the opened/unlocked position shown in FIG. 11 to the closed/locked position shown in FIG. 12. Further, and with reference to FIGS. 9A and 10A, in some embodiments the bent sections 34 can include sides 48, with slotted holes 50. The slotted holes 50 can be provided to receive a stub 52 anchored along the lid 14. The slotted holes 50 can be sized to allow the stubs 52 to slide relatively within the slotted holes 50, thereby further supporting sliding movement of the lid latch 30.

With reference to FIGS. 11 and 12, indentations 42*a* and 42*b* can be provided on along the lid 14. The plate section 32 of the lid latch 30 can have at each side extending spring tabs 44 that are biased outward away from the plate section 32. The tabs 44 can be provided with a detent with a rounded tip 46 that protrudes and can be received in the indentations 42*a*, 42*b*.

As the plate section 32 slides from an opened/unlock position to a closed/lock position, the tips 46 can move from lodged positions in indentations 42*a* as shown in FIG. 11, to lodged positions in indentation 42*b* as shown in FIG. 12, thereby indexing the lid latch 30 from one position to another. The spring bias in the tabs 44 is configured such that sufficient force is applied to lodge the tips 46 in the indentations 42*a* and 42*b* at the respective positions, to securely hold the lid latch 30 in place at the respective positions.

With reference to FIGS. 9A and 10A, in some embodiments, the periphery of the opening of the body 12 can have an outwardly extending flange or ledge 54. In the open/unlocked position shown in FIG. 9A, the lip 36 of the lid latch 30 can be released (i.e., does not catch) from the ledge 54, allowing the lid 14 to be opened with respect to the body 12. In the closed/locked position shown in FIG. 10A, the lip 36 of the latch 30 can be latched onto (i.e., catch) the ledge 54, thereby locking the lid 14 against the body 12. In some embodiments, the ledge 54 can be formed from an upper portion of a side wall of the body 12. In some embodiments, the ledge 54 can extend from the internal cavity defined by the body 12. Additionally, stiffening ribs (not shown) can extend between the ledge 54 and an outer surface of the body 12 to enhance the stiffness of the ledge 54.

While the above described embodiments are directed to deployment of the lid latch 30 in a step-type trash container having a pivoted lid, it is understood that the lid latch 30 can be used in a trash container that has a lid 14 that is not attached to the container body, such as a lid 14 that is removed or separated from the container body 12 when opening the lid 14.

Figure 17:
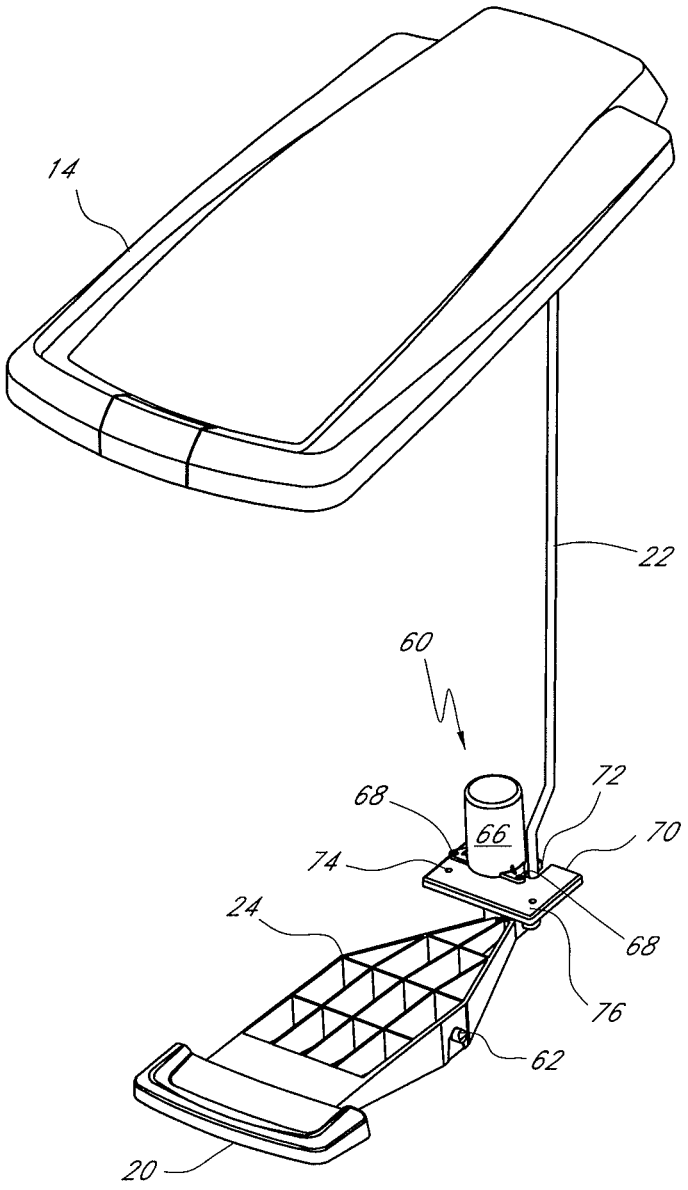
FIG. 17 is a left perspective view of the trashcan, with the body and wheels removed.
Figure 18:
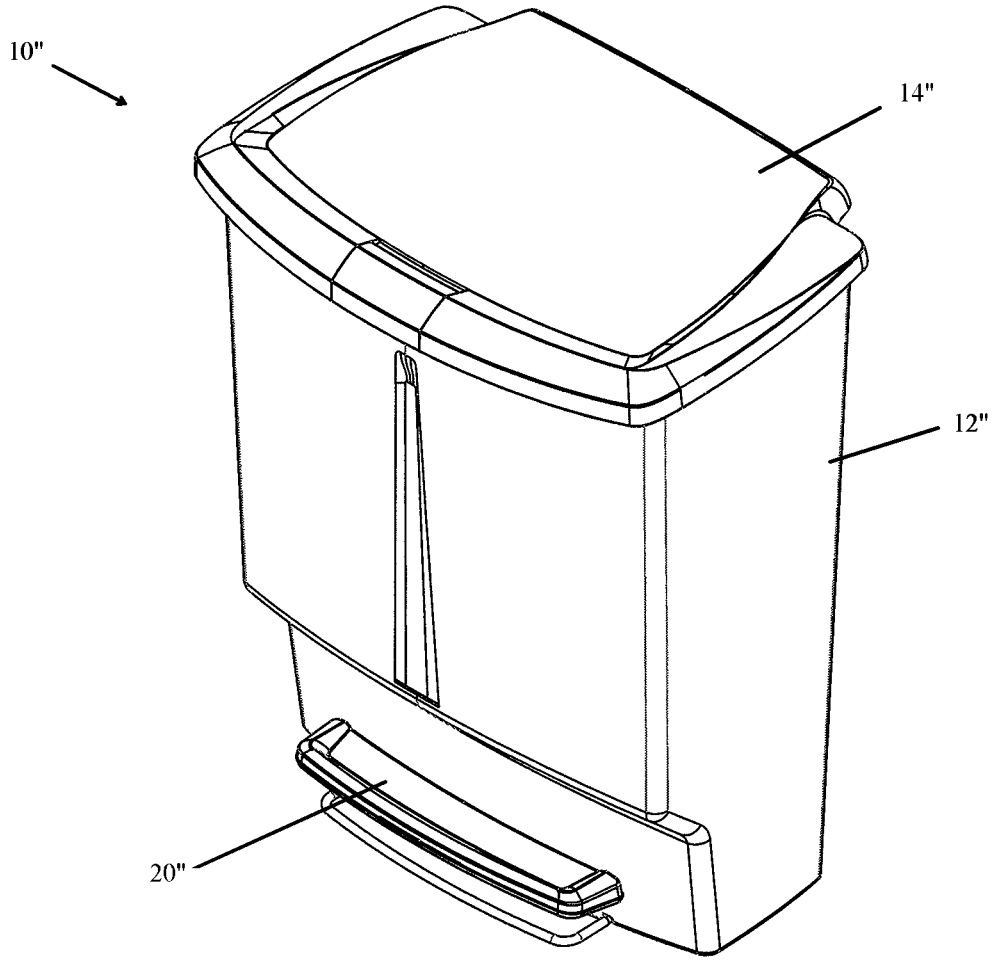
FIG. 18 is a top, left perspective view of a trash can in accordance with another embodiment.
Figure 19:
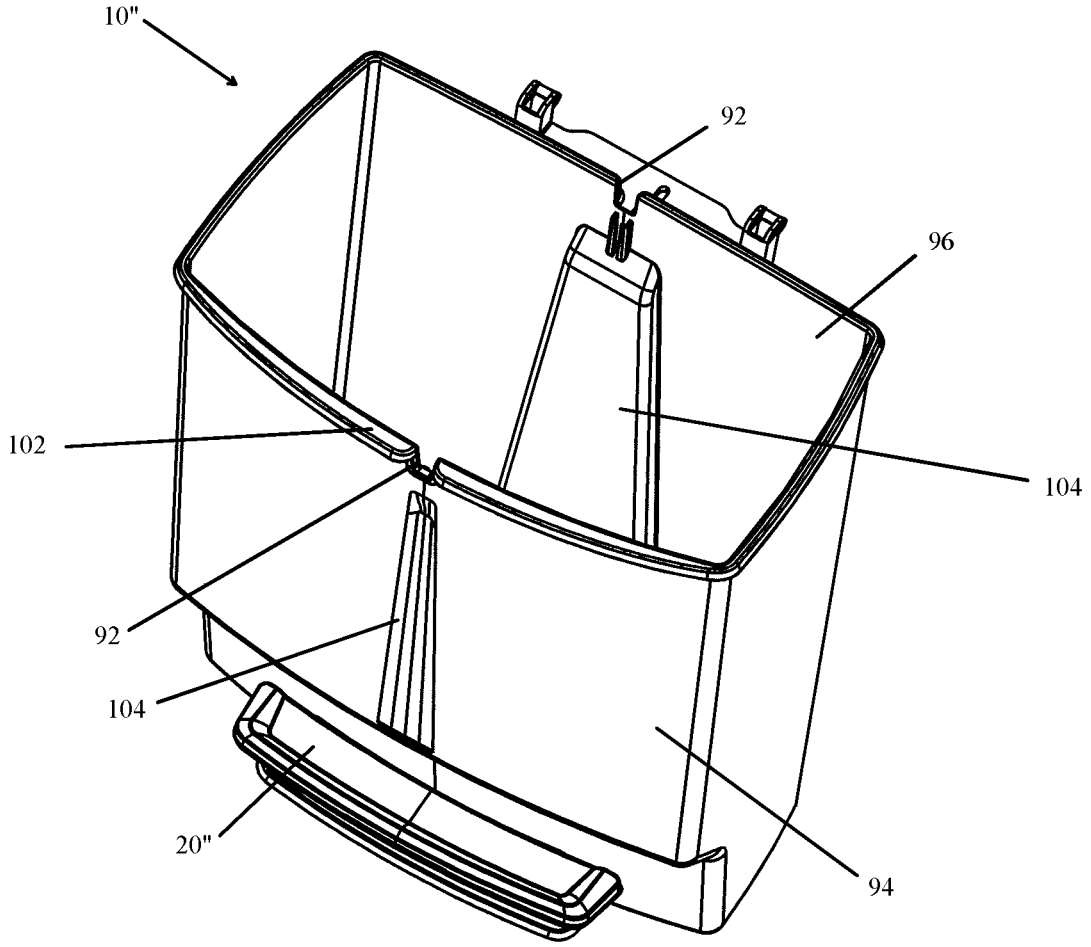
FIG. 19 is a top, left perspective view of the trash can of FIG. 18, with the lid removed.

With reference to FIGS. 5 and 17, in some embodiments the trashcan 10 can include a damping mechanism 60 configured to dampen the movement of the lid 14. For example, and with reference to FIG. 17, a damping mechanism 60 can be disposed at an end of the lever member 24 connecting the pedal 20 with the linkage 22. In some embodiments, the linkage 22 can comprise a lifting rod. The lifting rod 22 can be connected to an end of the lever member 24 that is opposite the pedal 20. As such, when a user depresses the pedal 20, the lever member 24 can pivot about a pivot member 62, thereby causing the lifting rod 22 to rise and open the lid 14.

As shown in FIGS. 5 and 17, the damping mechanism 60 can have a piston rod portion 64 and a cylinder portion 66. The construction and operation of this type of damping mechanism is disclosed in U.S. Patent Publication No. 2007/0012699, the entire contents of which is incorporated herein by reference.

In some embodiments, the lower end of the piston rod 64 can be connected to an end of the lever member 24 that is opposite the pedal 20. In other embodiments, the lower end of the piston rod 64 can be connected to an end of the lifting rod 22. When a user steps on the pedal 20, the end of the lever member 24 connected to the lifting rod 22 can rise, thereby opening the lid 14 by raising the lifting rod 22, and causing the piston rod 64 to rise. The damping mechanism 60 can dampen the movement of the lid toward the closed position by slowing the downward movement of the lifting rod 22 and lid 14. Alternatively, in some embodiments the damping mechanism 60 can dampen upward movement of the lifting rod 22 and lid 14.

Due to the damping provided by the damping mechanism 60, the damping mechanism 60 itself can experience significant loads. Thus, and with continued reference to FIG. 17, the cylinder portion 66 can include a plurality of flanges 68. The flanges 68 can be used to secure and mount the cylinder portion 66 in a fixed position relative to the body 12.

Often, the bodies of trashcan are made from softer, more malleable plastics, such as high impact polypropylene or other relatively softer plastic materials. However, other hardnesses can also be used. Thus, because these types of plastics are soft, if the cylinder portion 66 is attached directly to the body 12, the cylinder portion 66 is more likely to move or twist under the loads generated during operation of the pedal 20 and the closing movement of the lid 14. Additionally, such softer materials can fail from fatigue.

Thus, to provide a more secure and reliable attachment of the damping mechanism 60 to the body 12, the trashcan 10 can include a mounting platform 70, as seen for example in FIG. 17. In some embodiments, the mounting platform 70 can be made from material that is harder than the material used to make the body 12. For example, but without limitation, the mounting platform 70 can be made from Acrylonitrile Butadiene Styrene (ABS) plastic, or other materials.

With reference to FIG. 17, the mounting platform 70 can include an opening 72 such as a groove or an aperture configured to allow the lifting rod 22 to freely move up and down as the user steps on or releases the pedal 20. The mounting platform 70 can be attached to the cylinder portion 66 using the flanges 68 and any type of fastener.

The mounting platform 70 can be connected to the body 12 in any known manner. In some environments, the mounting platform 70 can include apertures 74, 76 through which threaded fasteners can extend to attach the platform 70 to the body 12.

With reference to FIG. 7, in some embodiments, the body 12 can include a downwardly facing surface 78. The mounting platform 70 can be attached to the downwardly facing surface 78, for example, with fasteners extending through the holes 74, 76. Additionally, the mounting platform 70 can also be glued to the lower surface 78.

With the mounting platform 70 attached to the downwardly facing surface 78, when the pedal 20 is depressed and the lifting rod 22 and the piston rod 64 are raised, all of the associated forces imparted to the mounting platform 70 can be transferred to the downwardly facing surface. 78 of the body 12. This provides the attachment of the damping mechanism 60 to the body 12 with enhanced strength that can better withstand the forces generated because a user can step on the pedal 20 with all of their weight. Thus, the upward movement of the piston rod 64 can be quite fast, and thus can cause significant forces on the mounting member 70.

When the pedal 20 is released, thereby allowing the lid 14 to close, the lifting rod 22 can fall along with the piston rod 64. The structure(s) within the cylinder member 66 can slow the movement and also impart loads onto the mounting platform 70. These loads can be transferred to the body 12 through the fasteners and/or any other attachment means for attaching the mounting platform 70 to the body 12.

In some embodiments where the mounting platform 70 is made from a harder material than that used for the body 12, the mounting platform 70 may not deform as greatly as it would if it were made from the same, or softer, material as that of body 12. Thus, the damping mechanism 60 can perform more reliably and consistently when used in conjunction with the mounting platform 70.

With reference to FIGS. 3 and 4, in some embodiments the trashcan 10 can be configured to be stackable. For example, the trashcan body 12 can have a tapered shape, expanding outwardly and upwardly. As shown in FIGS. 3 and 4, the outer surfaces of the body 12 can be tapered outwardly and upwardly. As such, with the lid 14 removed, a plurality of the trashcans 10 can be stacked one within another.

With reference to FIG. 7, the trashcan 10 can be configured such that the features near the bottom of the trashcan 10 fall entirely within a footprint of the upper portion of a side wall forming the body 12. For example, as shown in FIG. 7, the pedal 20 and the wheels 18, as seen in a bottom plan view, can fall entirely within a periphery 80 defined by an upper portion of a side wall forming the body 12. As such, when one trashcan 10 is stacked within another, the pedal 20 and the wheels 18 can fit within the cavity of another trashcan.

With continued reference to FIG. 7, in some embodiments the trashcan 10 can include a pedal protector, such as pedal protector 82 (shown transparently in FIG. 7). The pedal protector 82 can be attached to a lower surface 84 of the body 12. In some embodiments, the pedal protector 82 can be fixed to the lower surface 84 with threaded fasteners, such as screws, extending through apertures 85 in the pedal protector 82. However, other devices can also be used for fixing the pedal protector 82 to the lower surface 84.

In some embodiments, the pedal protector 82 can serve as a stabilizing structure that provides stability to the trash can 10 and inhibits or prevents the trash can 10 from easily being tipped over. In some embodiments the pedal protector 82 can inhibit or prevent the pedal 20 from rubbing against or contacting a ground surface, and being worn or damaged.

The pedal protector 82 can be in the form of a generally U-shaped bar having arms 86, though other shapes and configurations are also possible. The lower surface 84 of trashcan 10 can include a recessed channel (not shown) into which one or more of the arms 86 of the pedal protector 82 can fit. As shown in FIGS. 4 and 7, multiple trashcans can be stacked within one another, with the pedal protector 82 of one trashcan facilitating a desired alignment of the trashcans within one other, and protecting the pedal 20 from damage. For example, when one trashcan 10' is stacked within another trashcan 10 as shown in FIG. 4, the pedal protector 82' of trashcan 10' can prevent the pedal 20' of trashcan 10' from contacting other portions of the interior of the trashcan 10.

With continued reference to FIG. 4, in some embodiments the trashcan 10 can include a brow portion 88 which extends over the pedal 20. In such embodiments, an interior surface of the brow portion 88 can serve as a resting place for the pedal protector 82' when the trashcan 10' is nested within the trashcan 10.

With reference to FIG. 7, in some embodiments the pedal protector 82 can be flipped and/or rotated, to allow the pedal protector 82 to be moved away from the pedal 20. For example, the pedal protector 82 can be pivotably attached to the lower surface 84. The pedal protector 82 can rotate about a pivot portion or portions 89. This can allow a U-shaped pedal protector 82 to be flipped towards the other side of the trashcan 10, and for example to hide under lower surface 84. In some embodiments, flipping the pedal protector 82 away from the pedal 20 can facilitate easier stacking of one can within another for easier shipping, and/or allow more trashcans to be stacked within one another in a give volume of space.

With continued reference to FIGS. 5 and 7, a rear surface of the body 12 can further include a channel 90 configured to receive the lifting rod 22. As such, the lifting rod 22 can be better protected when the trashcan 10 is stacked within another trashcan. With reference to FIG. 4, the trashcan 10 can also include a rear projecting portion 92. The rear projecting portion 92 can help in protecting the lifting rod 22 when the trashcan 10 is stacked within another trash can. For example, the rear projecting portion 92, when the trashcan 10 is stacked within another trashcan, can contact an upper peripheral edge of the body 12 of another trashcan, thereby preventing any portion of the lifting rod 22 from contacting an upper peripheral edge of another trashcan.

With reference to FIGS. 18-21, another embodiment of a trashcan 10" is illustrated. The trashcan 10" can include similar features of the trashcan 10 as described above. For example, the trashcan 10" can include a body 12", lid 14", and a pedal 20". The trashcan 10" can be configured to hold at least one trash bag. For example, the trashcan 10" can be configured to hold two trash bags separately from one another within the trashcan 10".

Figure 20:
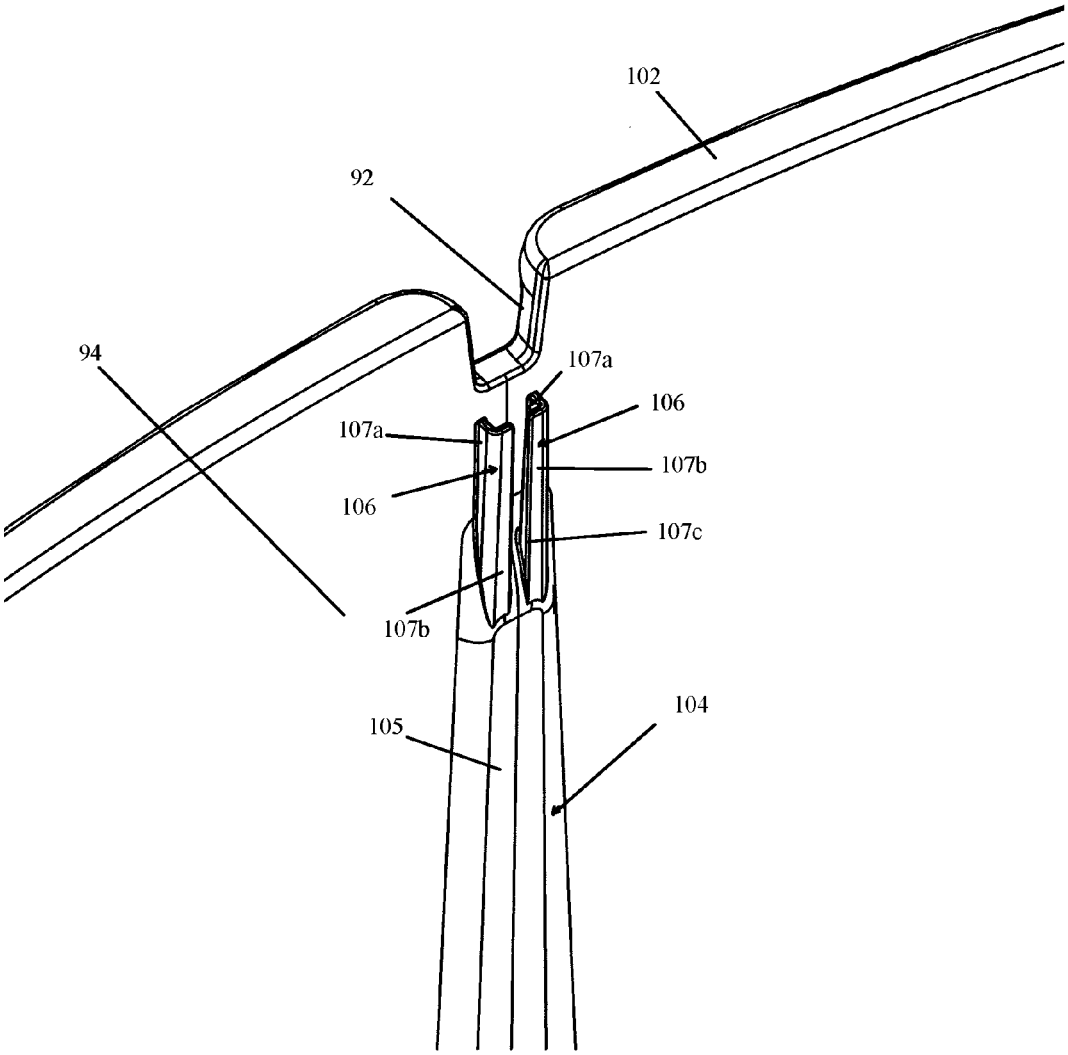
FIG. 20 is a partial, enlarged view of the inside of a front of the trashcan of FIG. 18.
Figure 21:
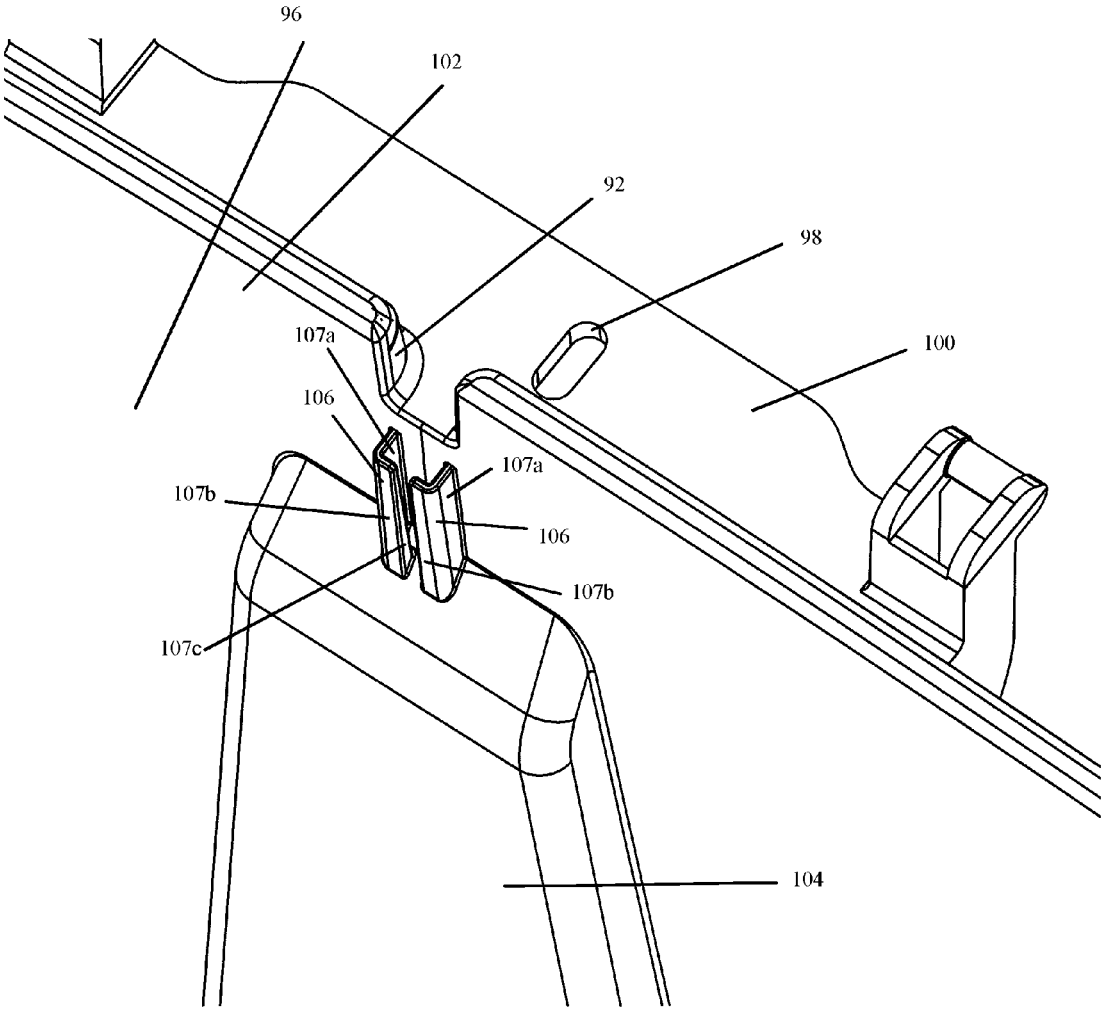
FIG. 21 is a partial, enlarged view of the inside of a back of the trashcan of FIG. 18.

With reference to FIGS. 19-22, 26, and 28, the trashcan 10" can comprise at least one notch 92 to facilitate insertion of at least one trash bag into the body 12". For example, and with reference to FIG. 19, one notch 92 can be formed along a front wall 94 of the body 12. The notch can have a "U" shape, though other shapes are also possible. The trashcan 10" can comprise at least one additional notch 92 along a back wall 96 of the trashcan 10" as well, to further facilitate insertion of multiple trash bags. The notches 92 can facilitate insertion of more than one trash bag into the body 12" of trashcan 10", for example, by providing areas on the body 12 to wrap and/or secure the trash bags. In some embodiments, one trash bag can be used for recycling on one side of the trash can 10", and another trash bag can be used for additional trash on the other side of the trashcan 10". The notches 92 can be used to secure the trash bags, and to help divide the trash can 10" into two or more compartments. With reference to FIG. 21, in some embodiments, an opening 98 can be formed near one of the notches 92. The opening 98 can be used, for example, as a bag tuck. In some embodiments, the opening 92 can be formed along a back ledge 100 of the body 12". In some embodiments, the notches 92 can extend entirely through an upper portion 102 of body 12".

With continued reference to FIGS. 18-22, the trashcan 10" can further comprise at least one support 104 in the body 12, which can optionally be in the form of an indentation. However, in some embodiments, the support 104 can be wholly within the interior of the body 12" and thus not-visible on the outside of the body 12". In some configurations, the support or "indentations" 104 can further facilitate a division of the trashcan 10" into various compartments, and can help for example to separate two trash bags used for different purposes. In some embodiments, and with reference to FIG. 20, the support 104 can include a support surface 105. The support surface 105 can be flat, grooved, or have other contours. In some embodiments the support surface 105 can be configured to contact and/or align with an edge of a dividing type member within the trashcan 10". In some embodiments the support surface 105 can support an edge of a dividing type member. For example, the support surface 105 can inhibit a dividing type member from twisting and/or torquing.

With continued reference to FIGS. 20 and 21, in some embodiments the trashcan 10" can comprise at least one divider holding component 106. The dividers holding components 106 can, for example, be integrally formed or connected with the body 12". The divider holding components 106 can be used to guide and/or hold a dividing type member within the cavity formed by the body 12", so as to divide the trashcan 10" into one or more compartments. The divider holding components 106 can be used to hold a diving type member in place. In some embodiments, the trashcan 10" can include divider holding components 106 along an upper portion of the trashcan 10", though additional, and/or other locations are also possible. In some embodiments the divider holding components 106 can have first walls 107*a*, second walls 107*b*, and lateral edges 107*c*. As illustrated in FIGS. 20 and 21, interior portions of the first walls 107*a* of two holding components 106 can face towards one another inside the trashcan 10", interior portions of the second wall 107*b* can face towards the front or back walls 94, 96 of the trashcan 10", and the lateral edges 107*c* of the components 106 can also face one another.

With reference to FIGS. 22-27, the trashcan 10" can comprise at least one divider 108. As noted above, the divider 108 can be a dividing type member. The divider 108 can be inserted into the divider holding components 106, and can be used to divide the trashcan 10" into one or more compartments. For example, the divider 108 can comprise a generally flat, dividing portion 110.

The divider 108 can further comprise at least one divider connection member 112. The divider connection member 112 can comprise an elongate member 114 that is configured to be received by the divider holding components 106. In some embodiments the elongate member 114 can form a generally I-beam-type shape. For example, and with reference to FIGS. 24 and 25, the elongate member 114 can include an outer flange 115*a*, a web 115*b*, and back flange surfaces 115*c*. In some embodiments the outer flange 115*a* can further include outer flange surfaces 115*d*.

The divider 108 can further comprise at least one shoulder portion 116. The at least one shoulder portion 116 can extend from the at least one elongate member 114, and can be configured to rest on top of a divider holding component or components 106, so as to hold the divider 108 in place within the body 12". For example, in some embodiments the shoulder portion 116 can rest on top of first and second walls 107*a*, 107*b* of the divider holding components 106, as illustrated for example in FIG. 26. In some embodiments, the shoulder portion 116 can be configured to be grabbed by a user (e.g. with a finger or fingers) and pulled directly upwards. Thus, the shoulder portion 116 can allow a user to pull the divider 108 vertically straight up out of a trashcan 10", without causing any significant twisting, or torquing, of the divider 108 or trashcan 10" while removing the divider 108. Pulling the divider 108 straight up out of the trashcan 10" can advantageously inhibit damage to the divider 108 and/or trashcan 10".

In some embodiments, one or more of the outer flange 115*a*, web 115*b*, back flange surfaces 115*c*, outer flange surfaces 115*d*, and shoulder portion 116 of a divider connection member 112 can contact one or more of the first wall 107*a*, second wall 107*b*, lateral edge 107*c*, and front or back walls 94, 96, to securely hold a divider 108 in place and/or inhibit twisiting and torquing of the divider 108 and/or trashcan 10". For example, in some embodiments the outer flange 115*a* can contact the front or back wall 94, 96 of trashcan 10". In some embodiments, the outer flange surfaces 115*d* can contact the first walls 107*a* of two divider holding components 106. In some embodiments, the web 115*b* can contact the lateral edges 107*c* of two divider holding components 106. In some embodiments, the back flange surfaces 115*c* can contact the second walls 107*b* of two divider holding components 106. In some embodiments, and as described above, the shoulder portion 116 can contact the top of first and/or second walls 107*a*, 107*b* of two divider holding components 106.

Figure 27:
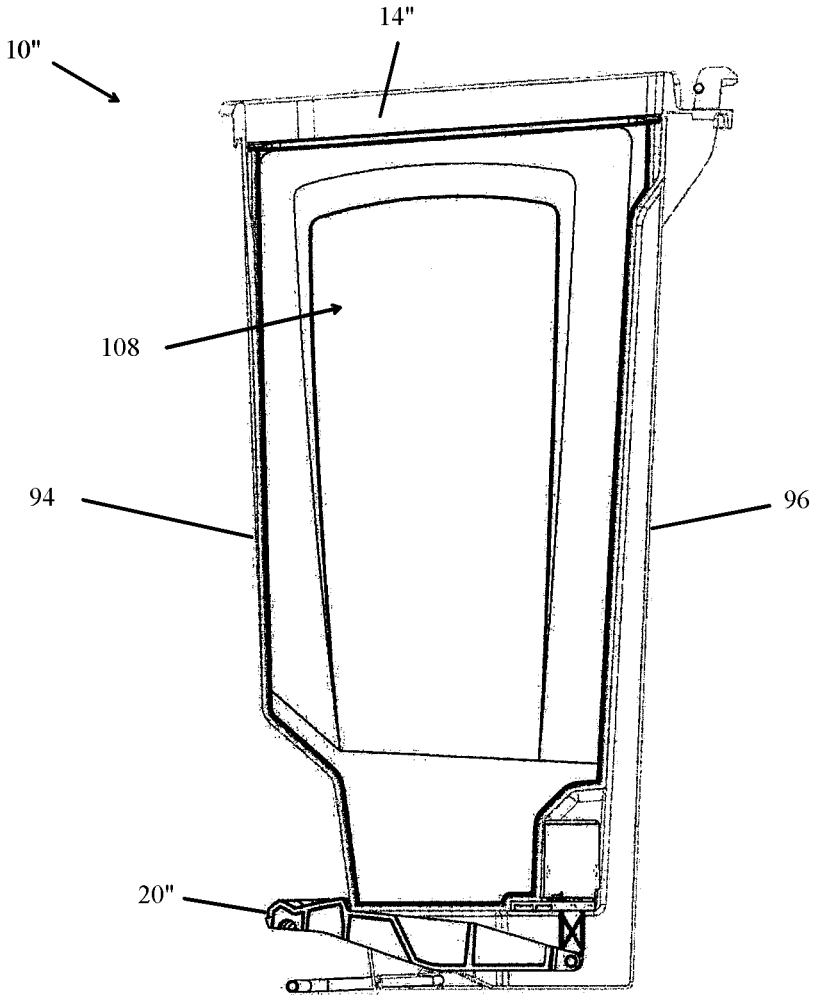
FIG. 27 is a left elevational cross sectional view of the trash can of FIG. 18, showing the divider positioned inside.

As illustrated in FIG. 27, the divider 108 can have a shape that is complimentary to the shape of the inside cavity formed by body 12". For example, the divider 108 can be contoured and shaped such that it generally matches the shape of the inside of body 12", thus leaving little or no spacing between the divider 108 and the front and back walls 94, 96, as well as the bottom of the trashcan 10". Leaving little or no spacing can be advantageous if a trash bag, filled with trash, begins to push or strain against the divider 108. If there are large enough gaps, portions of the filled trash bag could begin to slide or bulge in one or more portions past the divider 108 into the other side of the trashcan 10". This could lead to damage (e.g. tears) in the trash bag if a user tries to remove the trash bag from the trashcan 10", and the trash bag becomes stuck.

In some embodiments, the divider 108 can include a divider lip 117 that extends at least partially around the divider 108. For example, the divider 108 can include a divider lip 117 that extends substantially or entirely around the divider 108. The divider lip 117 can be thicker and/or stiffer than most of the divider 108 (e.g. the remainder of the divider portion 110), so as to provide added stability to the divider 108 and inhibit unwated twisting or torquing of the divider 108. The lip 117 can inhibit a filled trash bag from pushing or bulging against the divider 108. In some embodiments, the divider lip 117 can rest against or contact a support 104 and/or support surface 105 of trashcan 10".

The divider 108 can further be contoured and shaped such that it generally isolates one side of the interior cavity of trashcan 10" from another side of the interior cavity of trashcan 10". Such general isolation can facilitate one type of trash being collected on one side of the trashcan 10" and another type of trash being collected on another side of the trashcan 10".

Figure 22:
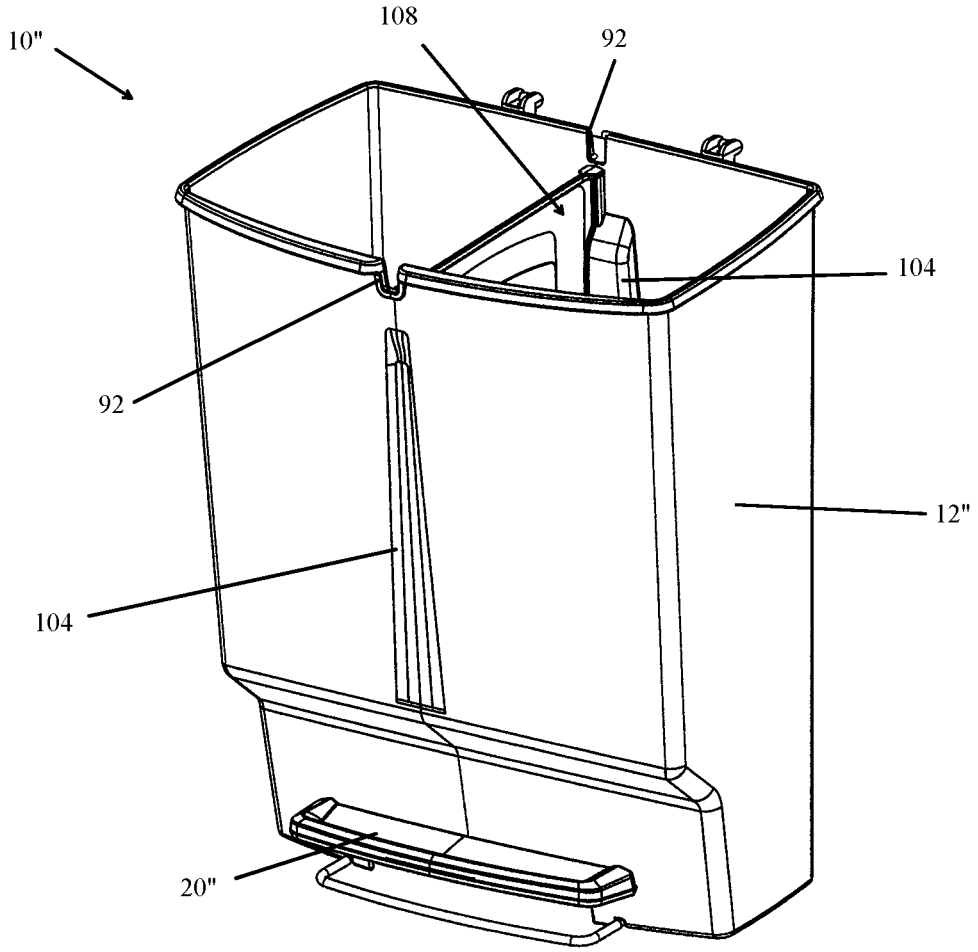
FIG. 22 is a top, left perspective view of the trashcan of FIG. 18, with a divider positioned inside.
Figure 23:
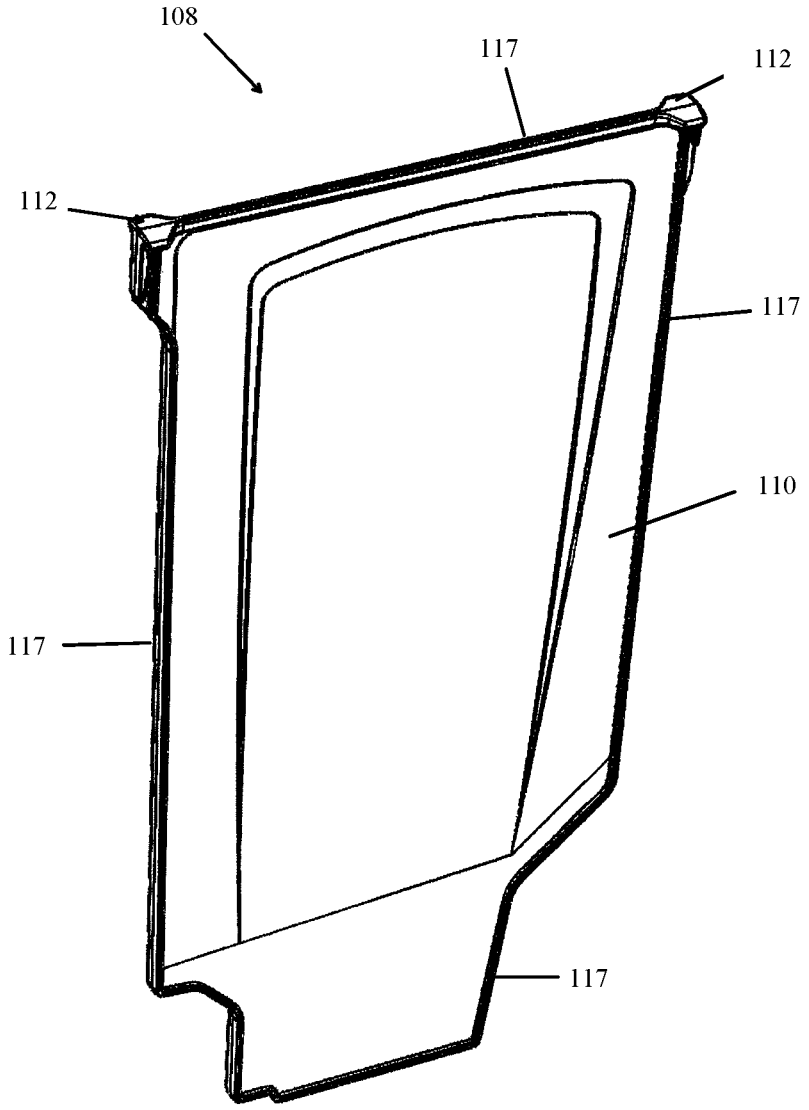
FIG. 23 is a perspective view of the divider from FIG. 22.
Figure 24:
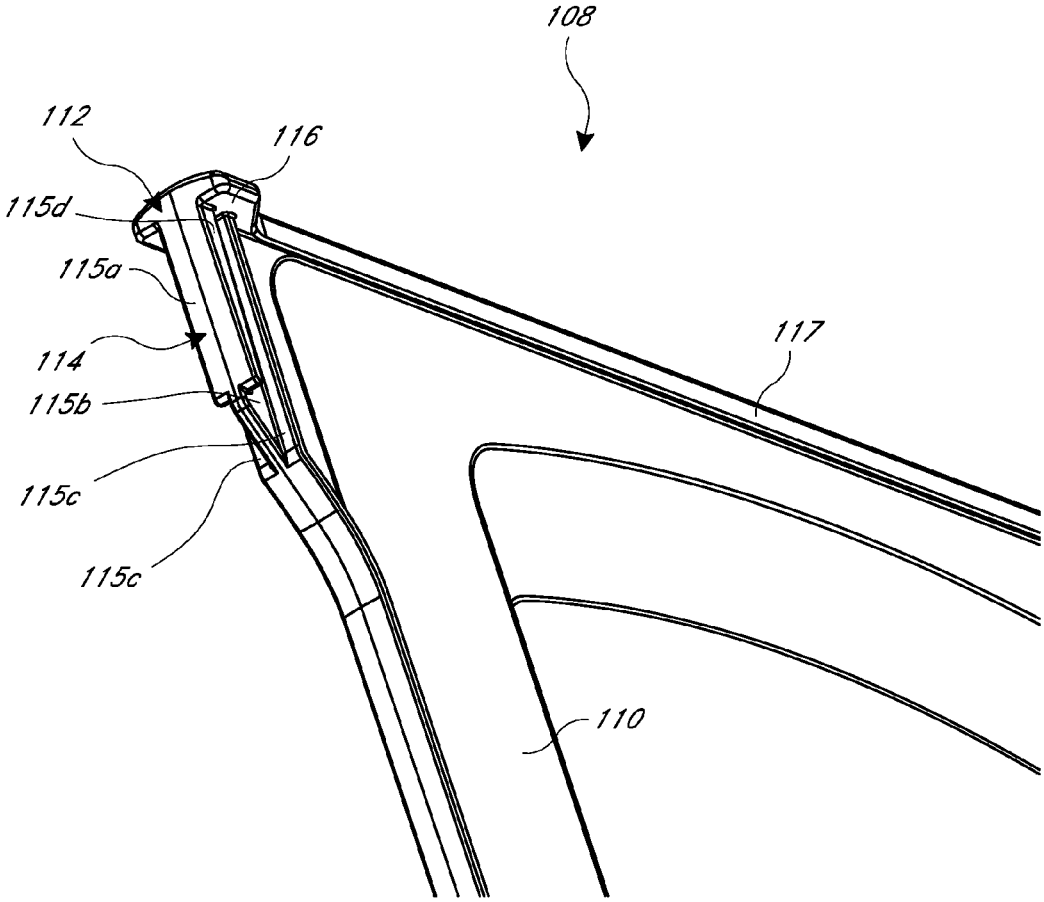
FIGS. 24 and 25 are partial, enlarged perspective views of the divider from FIG. 22.
Figure 25:
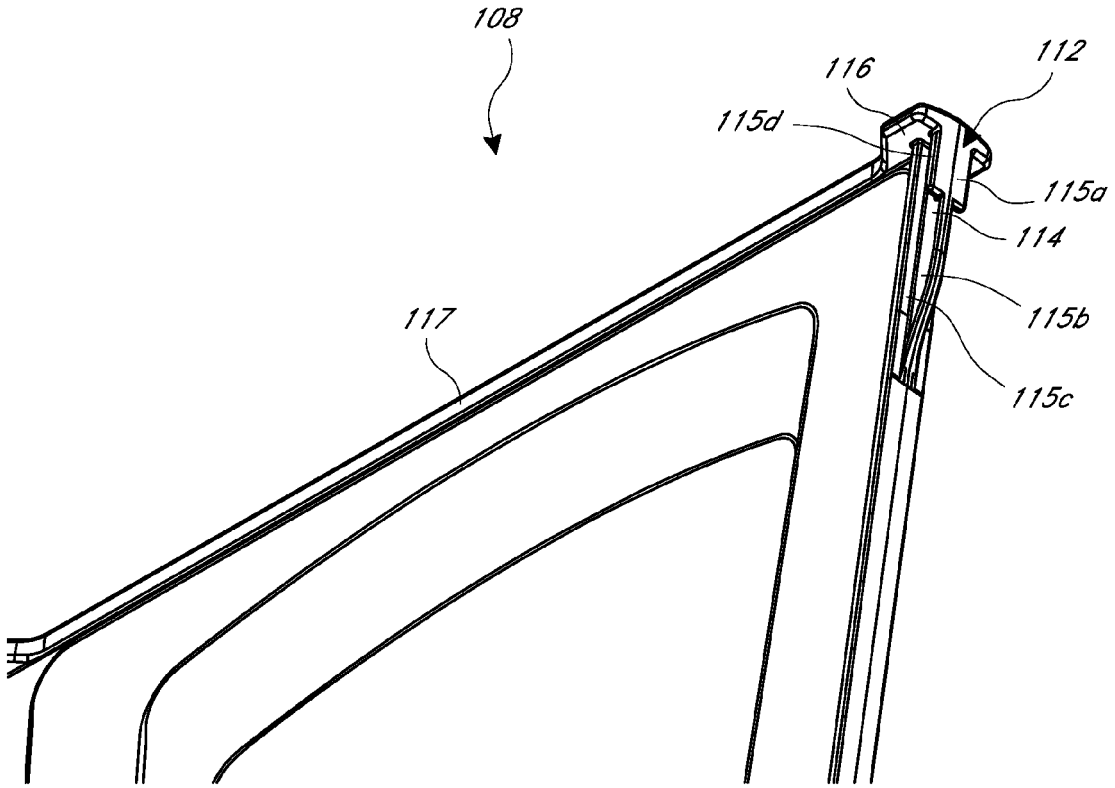
Figure 26:
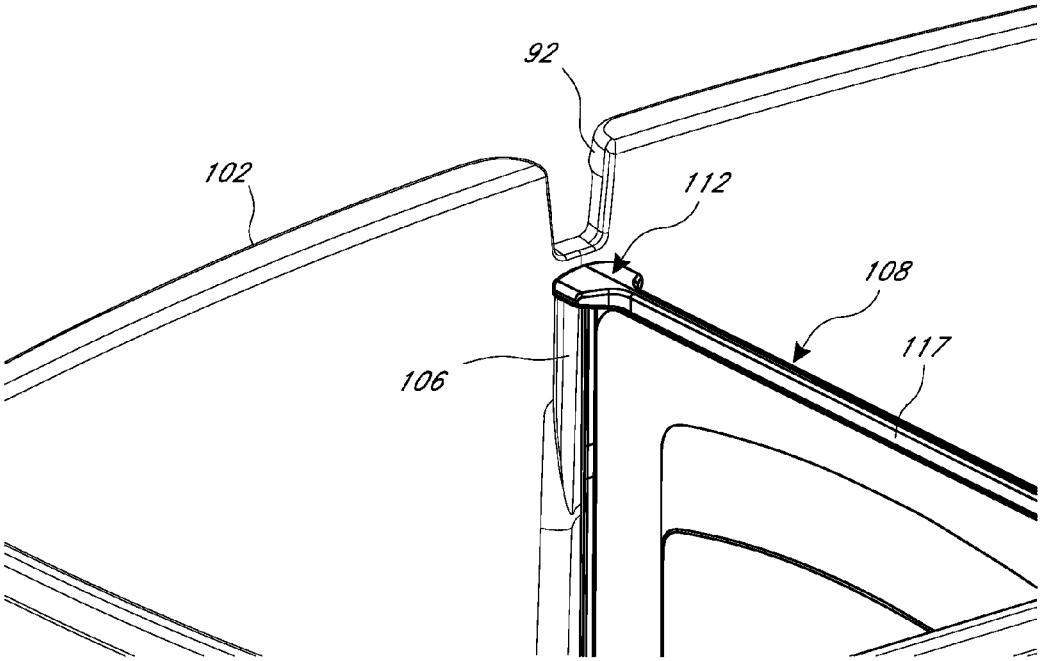
FIG. 26 is a partial, enlarged view of the front of the trashcan of FIG. 18, with the divider positioned inside.

Furthermore, and as illustrated for example in FIG. 22, the trashcan 10 can comprise a first notch 92 along an upper portion 102 of the body adjacent one end of the divider 108, and a second notch 92 along an upper portion 102 of the body adjacent another end of the divider 108. The first and second notches 92, along with the divider 108, can be configured to secure at least two trash bags inside the trashcan 10, and divide the trashcan 10".

With reference to FIGS. 28-32, the trashcan 10" can comprise a pedal protector 82". The pedal protector 82" can be similar to the pedal protector 82 described above. For example, the pedal protector 82" can be pivotably connected to the trashcan 10", and can be flipped for example from a first position adjacent a pedal 20" to a second position away from pedal 20".

Figure 30:
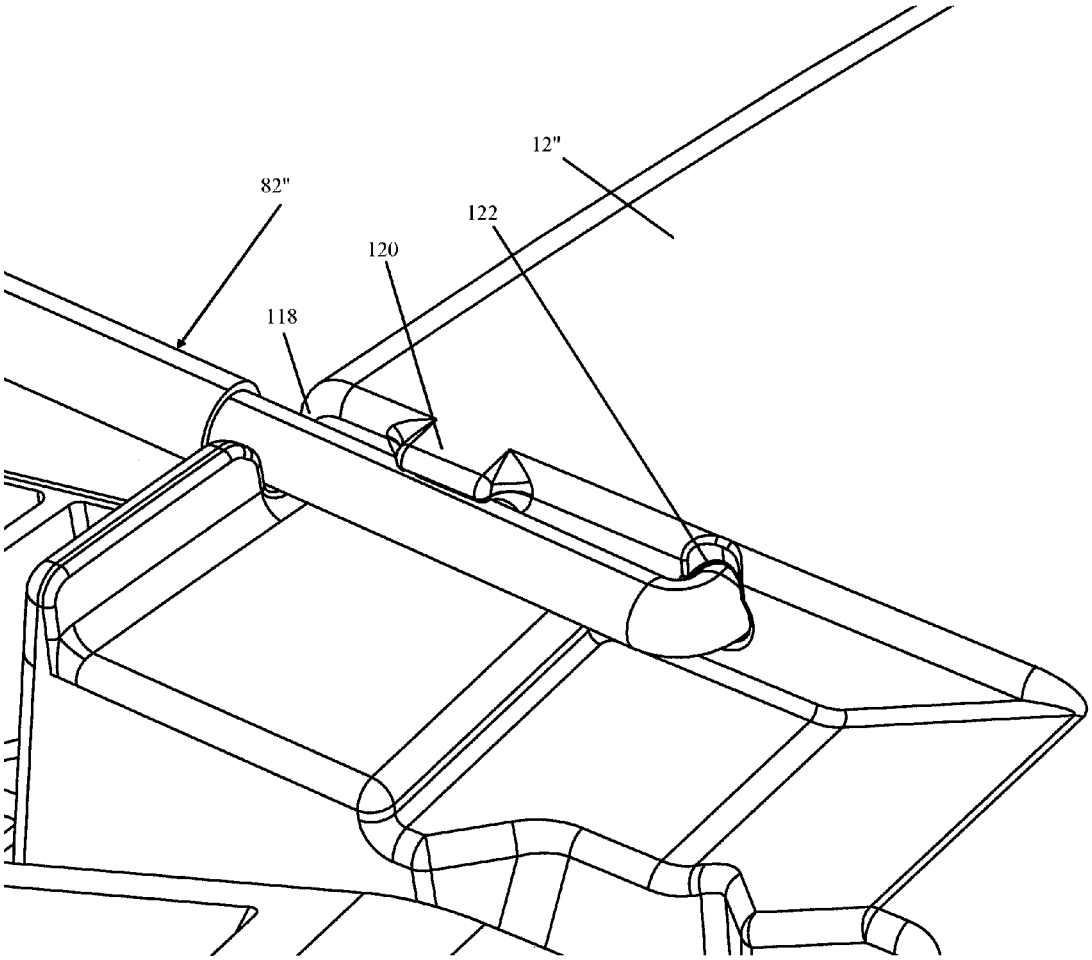

With reference to FIG. 30, in some embodiments the trashcan 10" can comprise a groove or recess 118 along the body 12". The groove or recess 118 can be configured to receive at least a portion of the pedal protector 82". The body 12" can further comprise a pedal protector retaining member 120. The pedal protector retaining member 120 can comprise, for example, a protrusion or protrusions. The pedal protector retaining member 120 can be configured to retain or hold the pedal protector 82" in place, for example within the groove or recess 118. For example, the pedal protector 82" can be moved such that it frictionally engages pedal protector retaining member 120, and/or slides past the pedal protector retaining member 116, thereby locking into the groove or recess 118.

Figure 31:
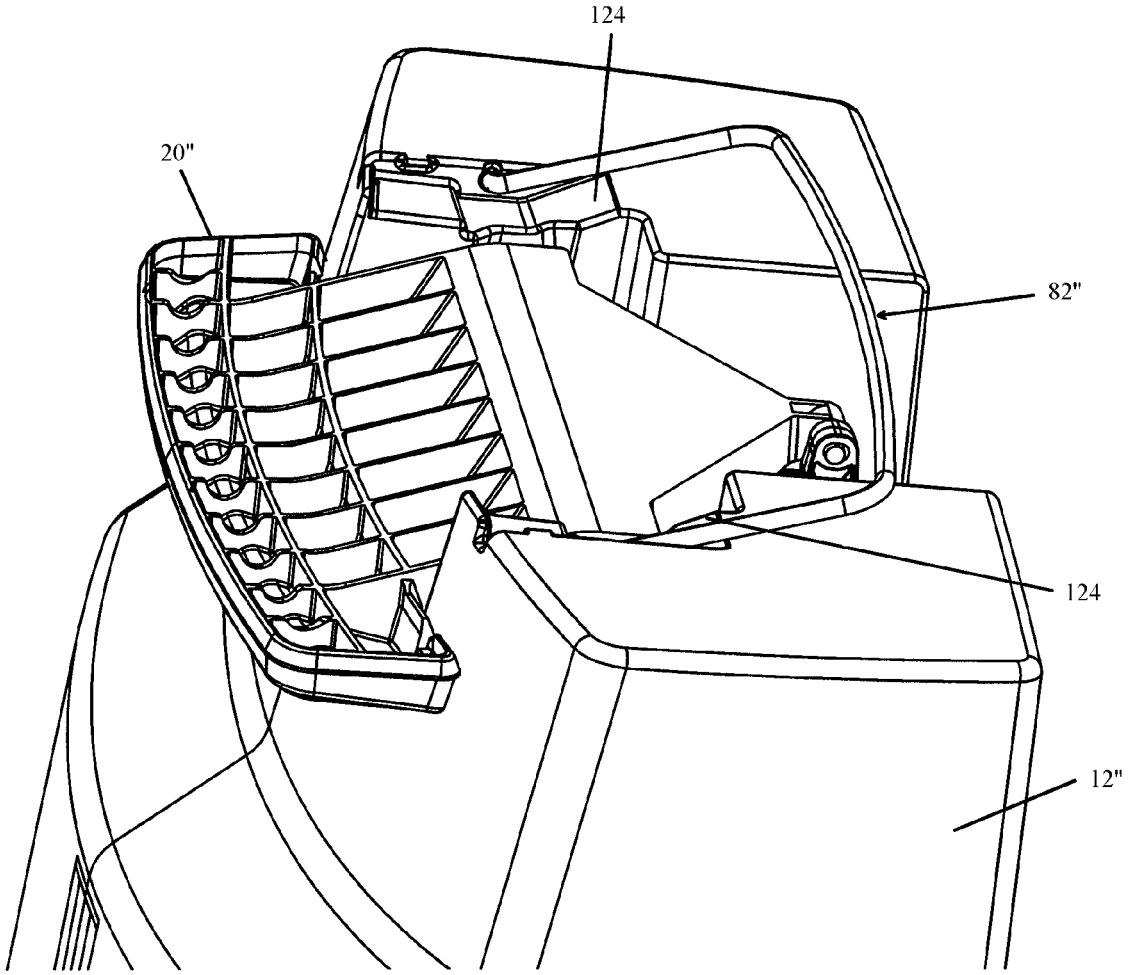
Figure 32:
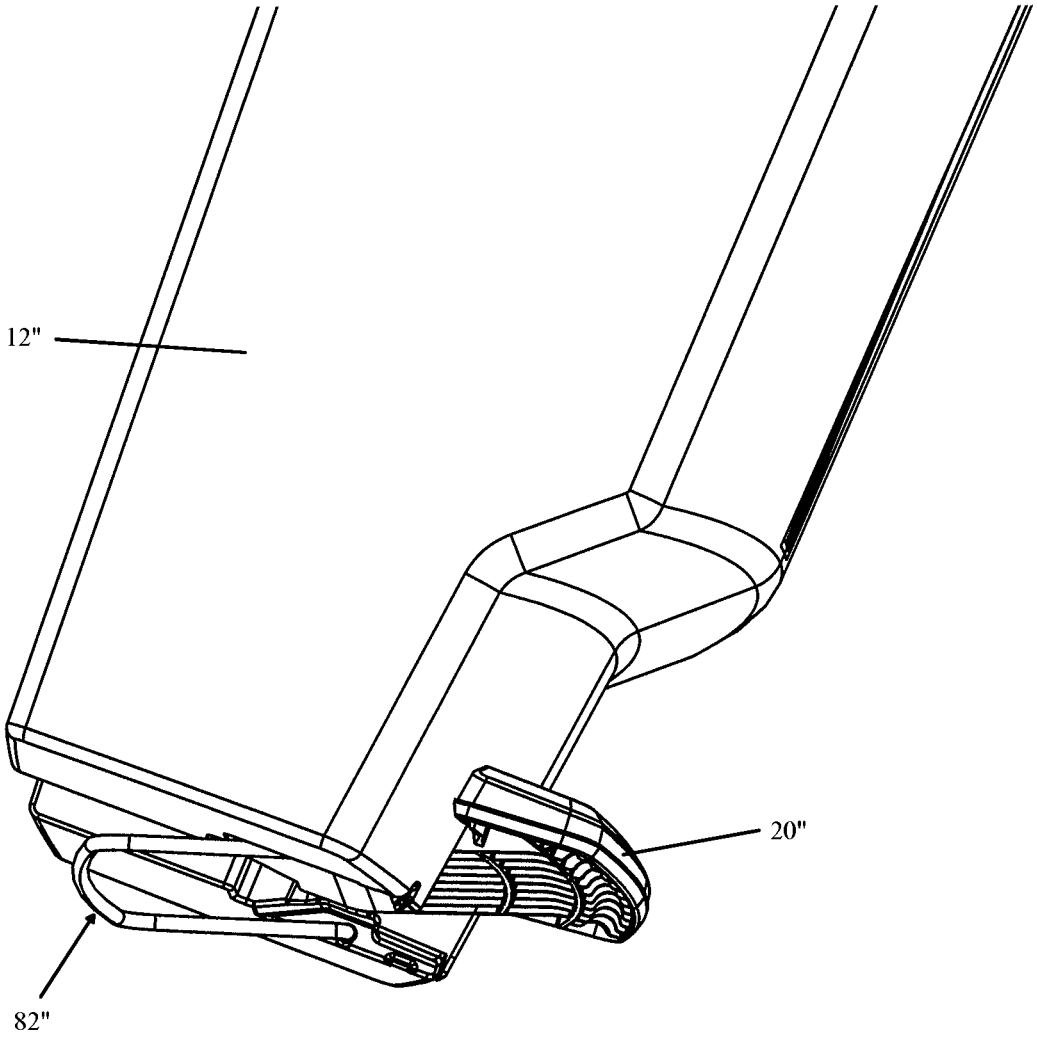

With continued reference to FIGS. 30-32, the body 12" can comprise an receptacle portion 122 that is configured to receive at least a portion of the pedal protector 82" so as to provide pivotal mounting of the pedal protector 82". For example, the receptacle can be in the form of an opening sized to receive a terminal end of the pedal protector 82". However, other configurations can also be used.

Figure 28:
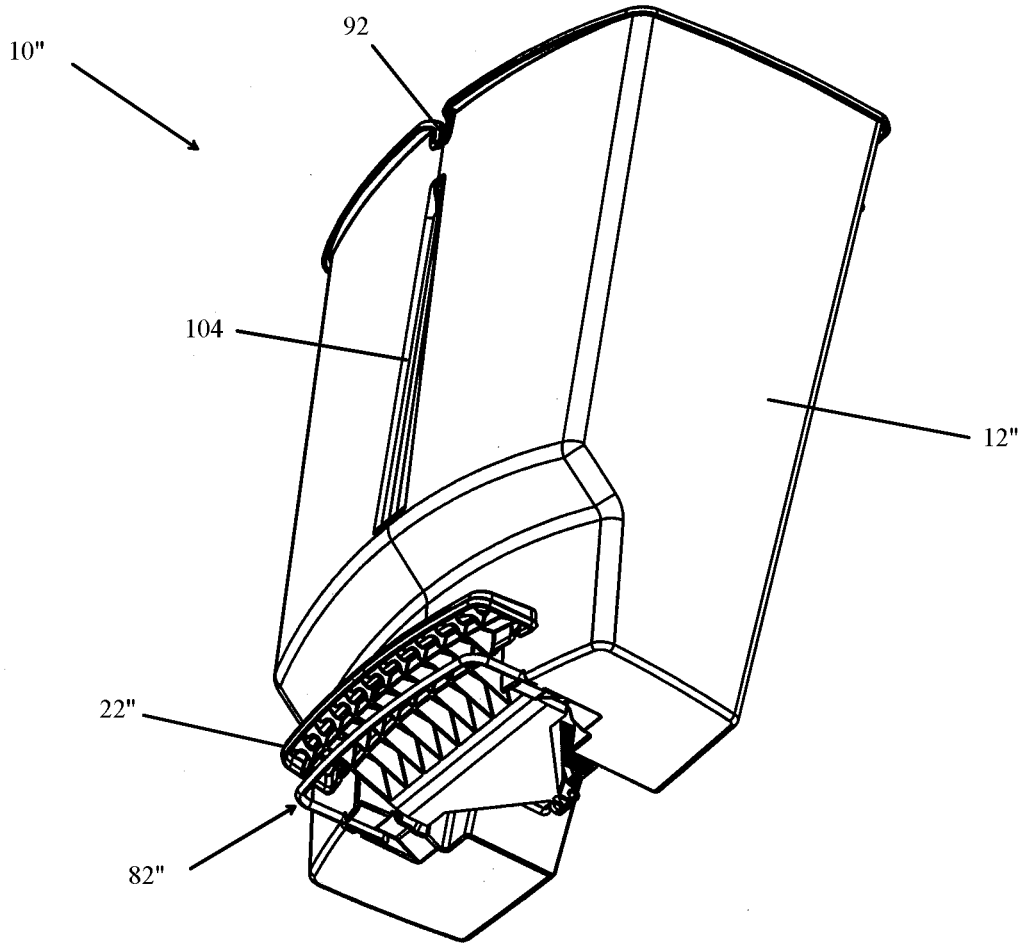
FIG. 28 is a bottom, left perspective view of the trash can of FIG. 18, showing a pedal protector.
Figure 29:
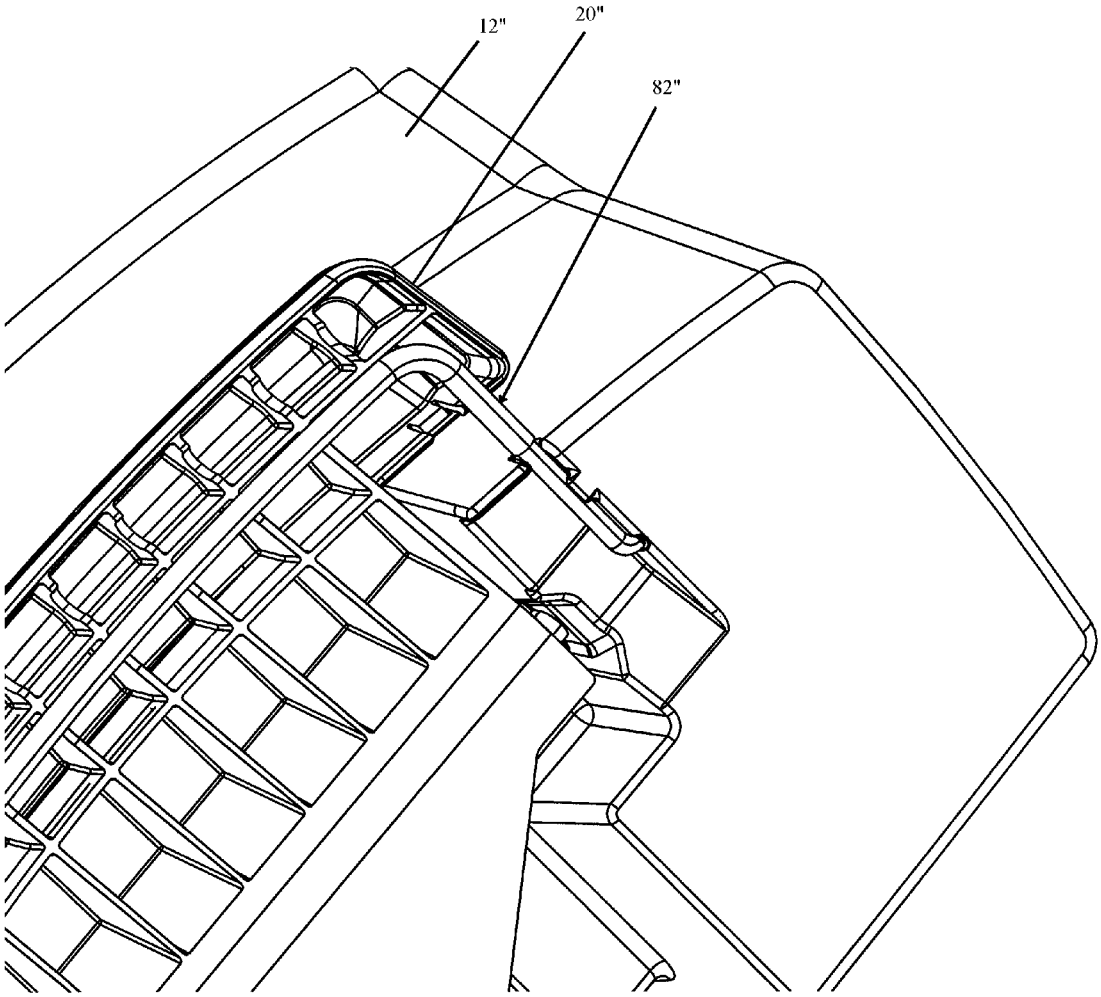
FIGS. 29-32 are enlarged, partial perspective views of the bottom of the trash can of FIG. 18, showing the pedal protector.

Pivotally mounted as such, the pedal protector 82" can pivot in the area of the opening 122. For example, as illustrated in FIGS. 28-30, the pedal protector 82" can be in a first position that is close to and beneath the pedal 20", which can also be referred to as a "deployed" position. Further, and as illustrated in FIGS. 31 and 32, the pedal protector 82" can pivot to a second position that is away from the pedal 20", which can be referred to as a "stowed" position. For example, in the "stowed" position, the pedal protector 82" be positioned within a periphery defined by the adjacent generally vertical walls of the body 12". The pedal protector 82" can rest, for example, against inclined portions 124 of the body 12" in the second position. As described above, the pedal protector 82" can be used as a stabilizing structure to inhibit or prevent the trashcan 10" from being tipped over, and/or to prevent the pedal 20" contacting or rubbing against the ground and becoming damaged or worn. Additionally or alternatively, the pedal protector 82" can be moved to the first position, second position, or other position, so as to facilitate stacking of a plurality of trashcans 10". For example, in some embodiments, flipping the pedal protector 82 away from the pedal 20 can facilitate easier stacking of one can within another for easier shipping, and/or allow more trashcans to be stacked within one another in a give volume of space.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A trashcan comprising:

a body comprising:

an interior cavity configured to receive trash;

at least one upper opening through which trash can be inserted into the interior cavity;

a front wall;

a rear wall; and a bottom end comprising:

a horizontal portion;

a vertical portion comprising a groove; and an inclined portion positioned rearward of the horizontal portion, the inclined portion being inclined relative to the horizontal portion and to the vertical portion;

a lid pivotally attached to the body so as to move between opened and closed positions;

a lid actuating system comprising a pedal and at least one linkage connecting the pedal with the lid, such that movement of the pedal causes opening and closing movement of the lid; and a pedal protector pivotably attached to the body, wherein the pedal protector is pivotable from a first position adjacent the pedal to a second position away from the pedal, the pedal protector being configured such that in the first position a portion of the pedal protector is received in the groove of the vertical portion of the body, and in the second position another portion of the pedal protector rests against the inclined portion.

2. A trashcan comprising:

a body comprising an interior cavity configured to receive trash, the trash can body having at least one upper opening through which trash can be inserted into the interior cavity;

a lid pivotally attached to the body so as to move between opened and closed positions;

a lid actuating system comprising a pedal and at least one linkage connecting the pedal with the lid, the lid actuating system configured such that the lid moves from the closed position to the open position in response to the pedal being depressed; and a pedal protector attached to the body, the pedal protector extending underneath a front portion of the pedal, the front portion of the pedal configured to be depressed by a user's foot;

wherein an underside of the pedal comprises a recess that extends from a first lateral side of the pedal to a second lateral side of the pedal, wherein the recess is shaped to receive an upper portion of a front length of the pedal protector from the first lateral side to the second lateral side, and wherein, the pedal and pedal protector are configured such that:

when the pedal is depressed, the upper portion of the pedal protector is received in the recess, and wherein, when the pedal is not depressed, the upper portion of the pedal protector is not received in the recess.

3. The trashcan of claim 2, wherein the pedal is pivotably attached to the body, wherein the pedal protector is pivotable from a first position adjacent the pedal to a second position away from the pedal.

4. The trashcan of claim 3, wherein the body comprises a horizontal wall and an inclined portion, the inclined portion being non-parallel and non-perpendicular to the horizontal wall, wherein the pedal protector is configured to rest against the inclined portion in the second position.

5. The trashcan of claim 3, wherein the body further comprises a groove or recess configured to receive at least a portion of the pedal protector in the second position.

6. The trashcan of claim 2, wherein the body comprises an opening that receives at least a portion of the pedal protector and a rear portion of the pedal.

7. The trashcan of claim 2, wherein the pedal protector comprises arms that form a generally U-shaped pedal protector.

8. The trashcan of claim 2, wherein the pedal protector is configured to inhibit the pedal of the trashcan from contacting a ground surface on which the trashcan rests.

9. The trashcan of claim 2, wherein the pedal protector is configured to be positioned so as to provide a stabilizing force to the trashcan, thus inhibiting the trashcan from tipping over, and also to facilitate stacking of multiple trashcans.

10. The trashcan of claim 1, wherein the pedal protector is positioned at a downward angle relative to the lower surface of the body when the pedal protector rests against the at least one inclined portion.

11. The trashcan of claim 1, further comprising:

at least one notch along the body for insertion of a trash bag;

a plurality of divider holding components located along the interior cavity; and a divider engaged with the plurality of divider holding components, the divider dividing the interior cavity into a plurality of cavities for receiving trash, the divider comprising a plurality of divider connection members having elongate members configured to be received within the divider holding components.

12. The trashcan of claim 1, wherein the vertical portion is adjacent the horizontal portion.

13. The trashcan of claim 1, wherein the horizontal portion is rearward of the vertical portion.

14. The trashcan of claim 1, wherein the horizontal and vertical portions are generally perpendicular planar members, and the inclined portion is a planar member that is angled with respect to the horizontal and vertical portions.

15. A trashcan comprising:

a body comprising:

an interior cavity configured to receive trash;

at least one upper opening through which refuse can be inserted into the interior cavity;

a front wall;

a rear wall; and a bottom end comprising a generally planar horizontal wall, a stop wall, and a channel;

a pedal comprising a rear portion and a front portion, the rear portion received in the channel, the front portion extending out of the channel;

a lid coupled with the body and configured to move between closed and opened positions;

a linkage that operatively connects the pedal with the lid such that pressing on the pedal moves the lid from the closed position to the open position; and a stabilizer attached to the body and configured to pivot from a deployed position to a stowed position in a first direction and from the stowed position to the deployed position in a second direction, the stabilizer comprising a leg and a lateral member, the trashcan configured such that:

in the deployed position, the stabilizer is adjacent to the front portion of the pedal, and in the stowed position:

the stabilizer is engaged with the bottom end of the body and extends away from the generally planar horizontal wall of the body at a non-zero acute angle;

the leg of the stabilizer is engaged with the stop wall of the bottom end, thereby inhibiting further pivoting of the stabilizer in the first direction; and a portion of the stabilizer is the lowest-most portion of the trashcan.

16. The trashcan of claim 15, wherein, in the stowed position, the stabilizer extends below the generally horizontal wall of the body.

17. The trashcan of claim 15, wherein, in the stowed position, a portion of the stabilizer is the lowest-most portion of the trashcan.

18. The trashcan of claim 15, wherein:

the stabilizer further comprises a second leg, and the lateral member connects the leg and the second leg, the entirety of the lateral member being spaced apart from the body when the stabilizer is in the stowed position.

19. The trashcan of claim 15, wherein, when the stabilizer is in the deployed position, the frontmost portion of the pedal is rearward of the frontmost portion of the stabilizer.

20. A trashcan comprising:

a body comprising:

a sidewall;

a bottom wall comprising a substantially horizontal planar portion, a stop wall, and a channel;

an opening having a periphery; and an interior cavity configured to receive trash, the interior cavity bounded on the top by the opening, on the side by the sidewall, and on the bottom by the bottom wall;

a lid pivotally attached to the body and movable between a closed position and an open position;

a linkage assembly comprising:

a pedal configured to be depressed, the pedal comprising a rear portion and a front portion, the rear portion received in the channel, the front portion extending out of the channel; and a linkage connecting the pedal with the lid such that the lid moves from the closed position to the open position in response to the pedal being depressed;

a damping mechanism operably connected with the linkage assembly, the damping mechanism configured to dampen movement of the lid during travel from the open position to the closed position; and a stabilizer bar attached to the body, the stabilizer bar configured to pivot about an axis of rotation from a deployed position to a stowed position in a first direction and from the stowed position to the deployed position in a second direction, a cross-member of the stabilizer bar being adjacent the front portion of the pedal in the deployed position and being adjacent the rear portion of the pedal in the stowed position, the axis of rotation being substantially co-planar with the substantially horizontal planar portion of the bottom wall of the body;

wherein, when the stabilizer bar is in the stowed position:

the leg of the stabilizer is engaged with the stop wall of the bottom end, thereby inhibiting further pivoting of the stabilizer in the first direction;

a portion of the stabilizer is the lowest-most portion of the trashcan; and the pedal, linkage, damping mechanism, and stabilizer bar are positioned within the periphery of the opening, thereby enabling the pedal, linkage, damping mechanism, and stabilizer bar of the trashcan to be received in an interior cavity of an identical trashcan.

21. The trashcan of claim 20, wherein the trashcan is configured to rest on the substantially horizontal planar portion of the bottom wall.

22. The trashcan of claim 20, wherein, when the stabilizer bar is in the deployed position, the substantially horizontal planar portion comprises the bottom-most portion of the trashcan.

23. The trashcan of claim 20, wherein the substantially horizontal planar portion is not surrounded by a downwardly extending flange.

24. The trashcan of claim 20, wherein, when the pedal is depressed and the lid is in the open position, the entirety of the linkage is external to the interior cavity.

25. The trashcan of claim 20, wherein the portion of the stabilizer comprises the cross-member.

26. The trashcan of claim 15, wherein the lowest-most portion comprises the lateral member.

27. The trashcan of claim 11, wherein the elongate members comprise I-beam configurations.

28. The trashcan of claim 11, wherein the elongate members comprise outer flanges with outer flange surfaces, webs connected to the outer flanges, back flange surfaces connected to the webs, and wherein the divider connection member further comprises shoulder portions extending from the elongate structure.

29. The trashcan of claim 11, wherein the divider comprises a divider lip that extends substantially entirely around the divider, the lip having a thickness greater than that of a majority of the divider, so as to provide the divider with greater stiffness in the lip.

30. The trashcan of claim 11, wherein the divider is secured in place in the trashcan by two divider holding components, one divider holding component along a front wall of the trashcan, and a second divider holding component along a back wall of the trashcan.

31. The trashcan of claim 11, wherein the divider generally takes the form of the inside cavity formed by body.

32. The trashcan of claim 11, wherein the at least one notch comprises a first notch on a front wall of the trashcan, and a second notch on a back wall of the trash can, wherein both the first and second notches comprise generally U-shaped openings that extend entirely through an upper portion of the body.

33. The trashcan of claim 1, wherein the body further includes an opening along a back ledge of the body for securing at least one trash bag.

34. The trashcan of claim 11, wherein the trashcan further comprises a first U-shaped notch along an upper portion of the body adjacent one end of the divider, and a second U-shaped notch along an upper portion of the body adjacent another end of the divider, the first and second U-shaped notches configured to be used to secure at least two trash bags inside the trashcan.

35. The trashcan of claim 11, wherein the trashcan is configured to receive two trash bags in the internal cavity, at least a portion of each of the trash bags wrapped around an upper portion of the body and at least one notch.

* * * * *